US005376512A

United States Patent [19]

Nakagawa et al.

[11] Patent Number: 5,376,512

[45] Date of Patent: Dec. 27, 1994

[54] SILVER HALIDE COLOR PHOTOGRAPHIC MATERIAL

[75] Inventors: Hajime Nakagawa; Yasuhiro Yoshioka, both of Minami-ashigara, Japan

[73] Assignee: Fuji Photo Film Co., Ltd., Kanagawa, Japan

[21] Appl. No.: 955,992

[22] Filed: Oct. 2, 1992

[30] Foreign Application Priority Data

Oct. 4, 1991 [JP] Japan ..... 3-283746

[51] Int. Cl.[5] ..... G03C 1/46

[52] U.S. Cl. ..... 430/503; 430/546; 430/551; 430/557

[58] Field of Search ..... 430/557, 546, 503, 551

[56] References Cited

U.S. PATENT DOCUMENTS

| | | | |
|---|---|---|---|
| 3,265,506 | 8/1966 | Weissberger et al. | 430/556 |
| 4,149,886 | 4/1979 | Tanaka et al. | 430/557 |
| 4,239,851 | 12/1980 | Aoki et al. | 430/546 |
| 5,001,045 | 3/1991 | Furutachi et al. | 430/546 |
| 5,194,369 | 3/1993 | Mihayashi | 430/557 |
| 5,212,052 | 5/1993 | Sakanoue et al. | 430/505 |
| 5,213,958 | 5/1993 | Motola et al. | 430/557 |

FOREIGN PATENT DOCUMENTS

| | | |
|---|---|---|
| 310552 | 4/1989 | European Pat. Off. . |
| 393718 | 10/1990 | European Pat. Off. . |
| 0447920 | 9/1991 | European Pat. Off. . |
| 47-26133 | 10/1972 | Japan . |
| 2254149 | 11/1987 | Japan . |
| 1204680 | 9/1970 | United Kingdom . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

There is disclosed a silver halide color photographic material, which comprises, in a yellow color-forming silver halide emulsion layer, one of nondiffusible yellow couplers represented by formula (I-1) or (I-2) and an organic compound represented by formula (II), or further an organic compound represented by formula (III):

formula (I-1)

formula (I-2)

wherein $X^1$ and $X^2$ each represent an alkyl group, an aryl group, or a heterocyclic group, $X^3$ represents an organic residue to form a nitrogen-containing heterocyclic group together with the >N—, Y represents an aryl group or a heterocyclic group, and Z represents a hydrogen atom or a coupling-releasing group, formula (II)

wherein $R^4$, $R^5$, $R^6$, and $R^7$ each represent a hydrogen atom, an aliphatic group, an aromatic group, an aliphatic-oxycarbonyl group, an aromatic-oxycarbonyl group, or a carbamoyl group, provided that each of $R^4$, $R^5$, $R^6$, and $R^7$ does not represent a hydrogen atom at the same time, formula (III)

wherein $R^8$, $R^9$, and $R^{10}$ each represent an alkyl group or an aryl group, and when $R^9$ and $R^{10}$ each represent an alkyl group, the alkyl groups may bond together to form a 5- or 7-membered ring.

20 Claims, No Drawings

SILVER HALIDE COLOR PHOTOGRAPHIC MATERIAL

FIELD OF THE INVENTION

The present invention relates to a silver halide color photographic material, and more particularly to a silver halide color photographic material high in stability of the emulsified dispersion system of a yellow coupler and improved in preservability of the processed color image.

BACKGROUND OF THE INVENTION

In silver halide color photographic materials, a color image is formed when the silver halide color photographic material is exposed to light and is subjected to color development wherein an oxidized aromatic primary amine color-developing agent reacts with dye-forming couplers (hereinafter referred to as couplers).

Generally, in this method, the color reproduction is effected by the subtractive color process, wherein in order to reproduce blue, green, and red, respectively yellow, magenta, and cyan color images complementary to them are formed. For the formation of a yellow color image, as a yellow dye-forming coupler (hereinafter referred to as yellow coupler), an acylacetamide coupler and a malondianilide coupler are generally used; for the formation of a magenta color image, as a magenta coupler, for example, a 5-pyrazolone coupler and a pyrazolotriazole coupler are generally used; and for the formation of a cyan color image, as a cyan coupler, a phenol coupler and a naphthol coupler are generally used.

The yellow dye, the magenta dye, and the cyan dye obtained from these couplers are generally formed in silver halide emulsion layers color-sensitive to radiations complementary to radiations which will be absorbed by these dyes or in layers adjacent to said silver halide emulsion layers.

Particularly for the formation of an image, as a yellow coupler, an acylacetamide coupler, represented by a benzoylacetanilide coupler and a pivaloylacetanilide coupler, is generally used. Since generally the former is high in coupling activity with an aromatic primary amine developing agent oxidized product at the time of development, and large in the molecular extinction coefficient of the yellow dye formed therefrom, it is used for photographing color photographic materials that require high sensitivity, particularly color-negative films, and since the latter is excellent in the spectral absorption characteristics and fastness of the yellow dye, it is used for color papers and color reversal films.

However, although benzoylacetanilide-type couplers are high in the coupling reactivity with the oxidized product of an aromatic primary amine developing agent at the time of color development and large in the molecular absorption coefficient of the yellow azomethine dye produced therefrom, they have a defect that the molecular absorption characteristics of the yellow dye are poor, while, although pivaloylacetanilide-type couplers are excellent in the spectral absorption characteristics of the yellow dye, they have defects that the coupling reactivity with the oxidized product of an aromatic primary amine developing agent at the time of color development is low and the molecular extinction coefficient of the yellow azomethine dye produced therefrom is small.

A high coupling reactivity of the coupler and a large molecular extinction coefficient of the dye formed therefrom make possible high sensitivity, a high gamma value, and high color density, thereby bringing about so-called high color-forming properties. The expression "excellent spectral absorption characteristics in yellow color images" means, for example, such absorption characteristics that the spectral absorption decreases sharply at the foot part in the long wavelength side and the undesired absorption of the green region is less.

Therefore, it is desired to develop a yellow coupler having merits of both of them, i.e., high color-forming properties (high in the coupling reactivity of the coupler and large in the molecular extinction coefficient of the dye) and excellent spectral absorption characteristics of the color image.

As the acyl group of acylacetanilide-type couplers, for example, a pivaloyl group, a 7,7-dimethylnorbornane-1-carbonyl group, and a 1-methylcyclohexane-1-carbonyl group are disclosed in U.S. Pat. No. 3,265,506, and a cyclopropane-1-carbonyl group and a cyclohexane-1-carbonyl group are described in JP-A ("JP-A" means unexamined published Japanese patent application) No. 26133/1972. However, these couplers are defective, for example, in that the coupling reactivity is poor, or the molecular extinction coefficient of the dye is small, or the spectral absorption characteristics of the color image are poor.

Concerning the new yellow couplers of the present invention represented by formulas (I-1) and (I-2), the color-forming properties are satisfactory, the molecular extinction coefficient of the dye formed therefrom is high, and the formed dye is good in the decrease of absorbance at the foot part in the long wavelength side, which gives a preferable dye in view of the color reproduction.

In comparison with a conventionally used benzoylacetanilide-type coupler or pivaloylacetanilide-type coupler, the dye produced from the present yellow coupler is remarkably excellent in fastness of the color image under heat and humidity exposure conditions, and it has satisfactory performance in color photographic materials for prints, wherein particularly image stability is required.

However, in the photographic material the dye formed from the present yellow coupler is poor in color image fastness to light, and improvement of the light fastness has been an important problem particularly in consideration of its use in photographic materials for prints.

Concerning the improvement of preservability of color images against light, measures of using light stabilizers, such as hindered phenols and piperidine compounds, are known. European Patent EP Nos. 310,552A1 and EP 393,718A2 describe methods wherein a sulfur-containing cyclic compound is additionally used.

However, the light fastness of the color-formed dye of the present yellow coupler is not satisfactory if the above method is used alone and further improvement is required.

Another problem with the photographic material employing the present coupler is its defect in that the stability of the emulsified dispersion of the coupler is poor. Deterioration of the stability of the emulsified dispersion brings about softening of gradation and a drop of the maximum color density of the color image after color development processing.

SUMMARY OF THE INVENTION

The first object of the present invention is to provide an emulsified dispersion excellent in stability by using a new yellow coupler excellent in color reproduction and a silver halide color photographic material containing the same.

The second object of the present invention is to provide a color photographic material excellent in stability of a color image by using the above yellow coupler.

Other and further objects, features, and advantages of the invention will appear more fully from the following description.

DETAILED DESCRIPTION OF THE INVENTION

The above first object is attained by a silver halide color photographic material having at least one cyan color-forming silver halide emulsion layer, at least one magenta color-forming silver halide emulsion layer, and at least one yellow color-forming silver halide emulsion layer, on a support, which comprises, in the said yellow color-forming silver halide emulsion layer, at least one nondiffusible yellow coupler represented by the following formula (I-1) or (I-2)and an organic compound represented by the following formula (II):

formula (I-1)

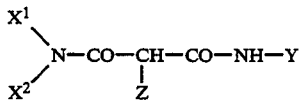

formula (I-2)

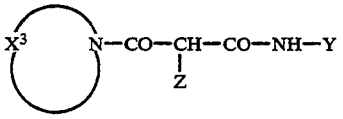

wherein $X^1$ and $X^2$ each represent an alkyl group, an aryl group, or a heterocyclic group, $X^3$ represents an organic residue to form a nitrogen-containing heterocyclic group together with the >N—, Y represents an aryl group or a heterocyclic group, and Z represents a hydrogen atom or a group capable of being released upon a coupling reaction of the coupler represented by formula (I-1) or (I-2) with the oxidized product of a color developing agent, and formula (II)

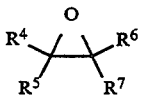

wherein $R^4$, $R^5$, $R^6$, and $R^7$ each represent a hydrogen atom, an aliphatic group, an aromatic group, an aliphatic-oxycarbonyl group, an aromatic-oxycarbonyl group, or a carbamoyl group, provided that each of $R^4$, $R^5$, $R^6$, and $R^7$ does not represent a hydrogen atom at the same time.

The above second object is attained by a silver halide color photographic material having at least one cyan color-forming silver halide emulsion layer, at least one magenta color-forming silver halide emulsion layer, and at least one yellow color-forming silver halide emulsion layer on a support, which comprises, in the said yellow color-forming silver halide emulsion layer, at least one of nondiffusible yellow couplers as stated above, an organic compound represented by formula (II) as stated above, and an organic compound represented by the following formula (III):

formula (III)

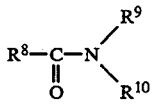

wherein $R^8$, $R^9$, and $R^{10}$ each represent an alkyl group or an aryl group, which may be substituted, by a halogen atom, an alkyl group, an alkoxy group, an aryl group, an aryloxy group, an alkylsulfonyl group, an arylsulfonyl group, an alkoxycarbonyl group, or a carbamoyl group, and where $R^9$ and $R^{10}$ each represent an alkyl group, which alkyl groups may bond together to form a 5- to 7-membered ring.

The couplers represented by formulas (I-1) and (I-2) are described below in detail.

In formula (I-1) or (I-2), when $X^1$ and $X^2$ represent an alkyl group, the alkyl group is a straight-chain, branched chain, or cyclic, saturated or unsaturated, substituted or unsubstituted alkyl group, having preferably a total number of carbon atoms (hereinafter abbreviated as a C-number) of 1 to 30, more preferably 1 to 20. Examples of the alkyl group are methyl, ethyl, propyl, butyl, cyclopropyl, allyl, t-octyl, i-butyl, dodecyl, and 2-hexyldecyl.

When $X^1$ and $X^2$ represent a heterocyclic group, the heterocyclic group is preferably a 3- to 12-membered, more preferably a 5- to 6-membered, saturated or unsaturated, substituted or unsubstituted, monocyclic or condensed ring heterocyclic group having preferably a C-number of 1 to 20, more preferably 1 to 10, and at least one heteroatom, such as a nitrogen atom, an oxygen atom, or a sulfur atom. As an example of the heterocyclic group, 3-pyrrolidinyl, 1,2,4-triazole- 3-yl, 2-pyridyl, 4prymidinyl, 3-pyrazolyl, 2-pyrrolyl, 2,4-dioxo-1,3-imidazolidine- 5-yl, or pyranyl can be mentioned.

When $X^1$ and $X^2$ represent an aryl group, the aryl group is a substituted or unsubstituted aryl group having preferably a C-number of 6 to 20, more preferably 6 to 10. As an example of the aryl group, a phenyl group and a naphthyl are typical.

When $X^3$ represents a nitrogen-containing heterocyclic group together with the >N-, the heterocyclic group is preferably a 3- to 12-membered, more preferably 5- to 6-membered, substituted or unsubstituted, saturated or unsaturated, monocyclic or condensed ring heterocyclic group that have preferably a C-number of 1 to 20, more preferably 1 to 15 and may contain in addition to the nitrogen atom, for example, an oxygen atom or a sulfur atom as a heteroatom. As an example of the heterocyclic group, pyrrolidino, piperidino, morpholino, 1-piperazinyl, 1-indolinyl, 1,2,3,4-tetrahydroquinoline-1-yl, 1-imidazolidinyl, 1-pyrazolyl, 1-pyrrolinyl, 1-pyrazolidinyl, 2,3-dihydro-1-indazolyl, 2-isoindolinyl, 1-indolyl, 1-pyrrolyl, 4-thiazine-S,S-dioxo-4-yl or benzoxadine-4-yl can be mentioned.

When $X^1$ and $X^2$ represent a substituted alkyl, aryl or heterocyclic group and $X^3$ represents a substituted nitrogen-containing heterocyclic group together with the >N—, examples of the substituent include: a halogen atom (e.g., fluorine and chlorine), an alkoxycarbonyl group (preferably having a C-number of 2 to 30, and more preferably 2 to 20, e.g., methoxycarbonyl, dodecyloxycarbonyl, and hexadecyloxycarbonyl), an acylamino group (preferably having a C-number of 2 to 30, and more preferably 2 to 20, e.g., acetamido, tetradecaneamido, 2-(2,4-di-t-amylphenoxy)butaneamido, and benzamido), a sulfonamido group (preferably having a C-number of 1 to 30, and more preferably 1 to 20, e.g., methanesulfonamido, dodecanesulfonamido, hexadecylsulfonamido, and benzenesulfonamido), a carbamoyl group (preferably having a C-number of 1 to 30, and more preferably 1 to 20, e.g., N-butylcarbamoyl and N,N-diethylcarbamoyl), an N-sulfonylcarbamoyl group (preferably having a C-number of 1 to 30, and more preferably 1 to 20, e.g., N-mesylcarbamoyl and N-dodecylsulfonylcarbamoyl), a sulfamoyl group (preferably having a C-number of 1 to 30, and more preferably 1 to 20, e.g., N-butylsulfamoyl, N-dodecylsulfamoyl, N-hexadecylsulfamoyl, N-3-(2,4-di-t-amylphenoxy)butylsulfamoyl, and N,N-diethylsulfamoyl), an alkoxy group (preferably having a C-number of 1 to 30, and more preferably 1 to 20, e.g., methoxy, hexadecyloxy, and isopropoxy), an aryloxy group (preferably having a C-number of 6 to 20, and more preferably 6 to 10, e.g., phenoxy, 4-methoxyphenoxy, 3-t-butylhydroxyphenoxy, and naphthoxy), an aryloxycarbonyl group (preferably having a C-number of 7 to 21, and more preferably 7 to 11, e.g., phenoxycarbonyl), an N-acylsulfamoyl group (preferably having a C-number of 2 to 30, and more preferably 2 to 20, e.g., N-propanoylsulfamoyl and N-tetradecanoylsulfamoyl), a sulfonyl group (preferably having a C-number of 1 to 30, and more preferably 1 to 20, e.g., methanesulfonyl, octanesulfonyl, 4-hydroxyphenylsulfonyl, and dodecanesulfonyl), an alkoxycarbonylamino group (preferably having a C-number of 1 to 30, and more preferably 1 to 20, ethoxycarbonylamino), a cyano group, a nitro group, a carboxyl group, a hydroxyl group, a sulfo group, an alkylthio group (preferably having a C-number of 1 to 30, and more preferably 1 to 20, e.g., methylthio, dodecylthio, and dodecylcarbamoylmethylthio), a ureido group (having a C-number of 1 to 30, more preferably 1 to 20, e.g., N-phenylureido and N-hexadecylureido), an aryl group (preferably having a C-number of 6 to 20, and more preferably 6 to 10, e.g., phenyl, naphthyl, and 4-methoxyphenyl), a heterocyclic group (which is a 3- to 12-membered, preferably, 5- to 6-membered, monocyclic or condensed ring having preferably a C-number of 1 to 20, and more preferably 1 to 10 and containing at least one heteroatom, such as a nitrogen atom, an oxygen atom, and a sulfur atom, e.g., 2-pyridyl, 3-pyrazolyl, 1-pyrrolyl, 2,4-dioxo-1,3-imidazolidine-1-yl, 2-benzoxazolyl, morpholino, and indolyl), an alkyl group (which may be straight-chain, branched chain, or cyclic and saturated or unsaturated and preferably has a C-number of 1 to 30, and more preferably 1 to 20, e.g., methyl, ethyl, isopropyl, cyclopropyl, t-pentyl, t-octyl, cyclopentyl, t-butyl, s-butyl, dodecyl, and 2-hexyldecyl), an acyl group (preferably having a C-number of 1 to 30, and more preferably 2 to 20, e.g., acetyl and benzoyl), an acyloxy group (preferably having a C-number of 2 to 30, and more preferably 2 to 20, e.g., propanoyloxy and tetradecanoyloxy), an arylthio group (preferably having a C-number of 6 to 20, and more preferably 6 to 10, e.g., phenylthio and naphthylthio), a sulfamoylamino group (preferably having a C-number of 0 to 30, and more preferably 0 to 20, e.g., N-butyl-sulfamoylamino, N-dodecylsulfamoylamino, and N-phenylsulfamoylamino), or an N-sulfonylsulfamoyl group (preferably having a C-number of 1 to 30, and more preferably 1 to 20, e.g., N-mesylsulfamoyl, N-ethanesulfonylsulfamoyl, N-dodecanesulfonylsulfamoyl, and N-hexadecanesulfonylsulfamoyl). These substituents may be further substituted. Examples of the substituent include those mentioned above.

Among the above substituents, preferable one includes, for example, an alkoxy group, a halogen atom, an alkoxycarbonyl group, an acyloxy group, an acylamino group, a sulfonyl group, a carbamoyl group, a sulfamoyl group, a sulfonamido group, a nitro group, an alkyl group, or an aryl group.

When Y in formulas (I-1) and (I-2) represents an aryl group, the aryl group is a substituted or unsubstituted aryl group preferably having a C-number of 6 to 20, and more preferably 6 to 10. Typical examples thereof are a phenyl group and a naphthyl group.

When Y in formulas (I-1) and (I-2) represents a heterocyclic group, the heterocyclic group has the same meaning as that of the heterocyclic group represented by $X^1$ and $X^2$.

When Y represents a substituted aryl group or a substituted heterocyclic group, examples of the substituent include those mentioned as examples of the substituent possessed by $X^1$. Preferable examples of the substituted aryl group and heterocyclic group represented by Y are those wherein the substituted group has a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamido group, or an alkyl group.

A particularly preferable example of Y is a phenyl group having at least one substituent in the ortho position.

The group represented by Z in formulas (I-1) and (I-2) may be any one of conventionally known coupling releasing groups. Preferably Z includes, for example, a nitrogen-containing heterocyclic group bonded to the coupling site through the nitrogen atom, an aryloxy group, an arylthio group, a heterocyclic-oxy group, a heterocyclic-thio group, an acyloxy group, a carbamoyloxy group, an alkylthio group, or a halogen atom.

These coupling releasing groups may be any one of non-photographically useful groups, photographically useful groups, or precursors thereof (e.g., a development retarder, a development accelerator, a desilvering accelerator, a fogging agent, a dye, a hardener, a coupler, a developing agent oxidized product scavenger, a fluorescent dye, a developing agent, or an electron transfer agent).

When Z is a photographically useful group, one which is conventionally known is useful. For example, photographically useful groups described, for example, in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571, or 4,741,994, and Europe Publication Patent Nos. 193389 A, 348139 A, or 272573 A or coupling releasing groups for releasing them (e.g., a timing group) are used.

When Z represents a nitrogen-containing heterocyclic group bonded to the coupling site through the nitrogen atom, preferably Z represents a 5- to 6-membered, substituted or unsubstituted, saturated or unsaturated, monocyclic or condensed ring heterocyclic group preferably having a C-number of 1 to 15, and more preferably 1 to 10. As heteroatom, in addition to the nitrogen atom, an oxygen atom or a sulfur atom may be present. As a preferable example of the heterocyclic group, 1-pyrazolyl, 1-imidazolyl, pyrrolino, 1,2,4-triazole-2-yl, 1,2,3-triazole-1-yl, benzotriazolyl, benzimidazolyl, imidazolidine-2,4-dione-3-yl, oxazolidine-2,4-dione-3-yl, 1,2,4-triazolidine-3,5-dione-4-yl, imidazolidine-2,4,5-trion-3-yl, 2-imidazolinone-1-yl, 3,5-dioxomorpholino, or 1-indazolyl can be mentioned. When these heterocyclic groups are substituted, the substituent includes those mentioned as examples of the substituent which may be possessed by the $X^1$ group. Preferable substituents are those wherein one substituent is an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group, or a sulfonyl group.

When Z represents an aromatic-oxy group, preferably the aromatic-oxy group is a substituted or unsubstituted aromatic-oxy group having a C-number of 6 to 10, and more preferably a substituted or unsubstituted phenoxy group. If the aromatic-oxy group is substituted, examples of the substituent include those mentioned as examples of the substituent which may be possessed by $X^1$ mentioned above. Among them, preferable substituents are those wherein at least one substituent is an electron-attractive substituent, such as a sulfonyl group, an alkoxycarbonyl group, a sulfamoyl group, a halogen atom, a carboxyl group, a carbamoyl group, a nitro group, a cyano group, or an acyl group.

When Z represents an aromatic-thio group, preferably the aromatic-thio group is a substituted or unsubstituted aromatic-thio group having a C-number of 6 to 10, and more preferably a substituted or unsubstituted phenylthio group. When the aromatic-thio group is substituted, examples of the substituent include those mentioned as examples of the substituent which may be possessed by $X^1$ mentioned above. Among them, preferable substituents are those wherein at least one substituent is an alkyl group, an alkoxy group, a sulfonyl group, an alkoxycarbonyl group, a sulfamoyl group, a halogen atom, a carbamoyl group, or a nitro group.

When Z represents a heterocyclic-oxy group, preferably the heterocyclic moiety has 1 to 20 carbon atoms, and more preferably 1 to 10 carbon atoms and at least one heteroatom, for example, one nitrogen atom, one oxygen atom, or one sulfur atom and is 3- to 12-membered, more preferably 5- to 6-membered, substituted or unsubstituted, saturated or unsaturated, monocyclic or condensed ring, heterocyclic group. As an example of the heterocyclic-oxy group, a pyridyloxy group, a pyrazolyloxy group, or a furyloxy group can be mentioned. When the heterocyclic-oxy group is substituted, examples of the substituent include those mentioned as examples of the substituent which may be possessed by $X^1$ mentioned above. Among them, preferable substituents are those wherein at least one substituent is an alkyl group, an aryl group, a carboxyl group, an alkoxy group, a halogen atom, an alkoxycarbonyl group, an aryloxycarbonyl group, an alkylthio group, all acylamino group, a sulfonamido group, a nitro group, a carbamoyl group, or a sulfonyl group.

When Z represents a heterocyclic-thio group, preferably the heterocyclic moiety has 1 to 20 carbon atoms, and more preferably 1 to 10 carbon atoms and at least one heteroatom, for example, one nitrogen atom, one oxygen atom, or one sulfur atom and is 3- to 12-membered, more preferably 5- to 6-membered, substituted or unsubstituted, saturated or unsaturated, monocyclic or condensed ring, heterocyclic group. As an example of the heterocyclic-thio group, a tetrazolylthio group, a 1,3,4-thiadiazolylthio group, a 1,3,4-oxadiazolylthio group, a 1,3,4-triazolylthio group, a benzoimidazolylthio group, a benzothiazolylthio group, or a 2-pyridylthio group can be mentioned. When the heterocyclic-thio group is substituted, examples of the substituent include those mentioned as examples of the substituent which may be possessed by $X^1$ mentioned above. Among them, preferable substituents are those wherein at least one substituent is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, a heterocyclic group, or a sulfonyl group.

When Z represents an acyloxy group, the acyloxy group is a monocyclic or condensed ring, substituted or unsubstituted, aromatic acyloxy group preferably having 6 to 10 carbon atoms or a substituted or unsubstituted aliphatic acyloxy group preferably having 2 to 30 carbon atoms, and more preferably 2 to 20 carbon atoms. When the acyloxy group is substituted, examples of the substituent include those mentioned as examples of the substituent which may be possessed by $X^1$ mentioned above.

When Z represents a carbamoyloxy group, the carbamoyloxy group is an aliphatic or aromatic or heterocyclic, substituted or unsubstituted carbamoyloxy group preferably having a C-number of 1 to 30, and more preferably 1 to 20. As an example, N,N-diethylcarbamoyloxy, N-phenylcarbamoyloxy, 1-imidazolylcarbonyloxy, or 1-pyrrolocarbonyloxy can be mentioned. When the carbamoyloxy group is substituted, examples of the substituent include those mentioned as examples of the substituent which may be possessed by $X^1$ mentioned above.

When Z represents an alkylthio group, the alkylthio group is a substituted or unsubstituted, straight-chain, branched chain, or cyclic, saturated or unsaturated alkylthio group having a C-number of 1 to 30, more preferably 1 to 20. When the alkyl thio group is substituted, examples of the substituent include those mentioned as examples of the substituent which may be possessed by $X^1$ mentioned above.

Now, couplers represented by formulas (I-1) and (I-2) that fall in a particularly preferable range will be described.

The group represented by $X^1$ in formula (I-1) is preferably an alkyl group, and particularly preferably an alkyl group having a C-number of 1 to 10.

The group represented by Y in formulas (I-1) and (I-2) is preferably an aromatic group, and particularly preferably a phenyl group having at least one substituent in the ortho position. The substituent includes those mentioned above, which may be possessed by the aromatic group represented by Y. Preferable substituents include preferable ones mentioned above, which may be possessed by the aromatic group represented Y.

The group represented by Z in formulas (I-1) and (I-2) includes preferably a 5- to 6-membered nitrogen-containing heterocyclic group bonded to the coupling site through the nitrogen atom, an aromatic-oxy group, a 5- to 6-membered heterocyclic-oxy group, or a 5- to 6-membered heterocyclic-thio group.

Preferable couplers in formulas (I-1) and (I-2) are represented by the following formula (I-3), (I-4), or (I-5):

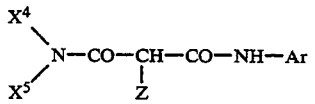

formula (I-3)

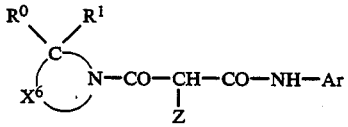

formula (I-4)

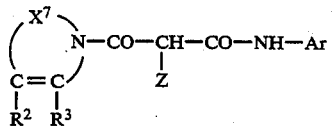

formula (I-5)

wherein Z has the same meaning as defined in formula (I-1), $X^4$ represents an alkyl group, $X^5$ represents an alkyl group or an aromatic group, Ar represents a phenyl group having at least one substituent in the ortho position, $X^6$ represents an organic residue to form a nitrogen-containing cyclic group (monocyclic or condensed ring) together with the $-C(R^0R^1)-N<$, $X^7$ represents an organic residue required to form a nitrogen heterocyclic group (monocyclic or condensed ring) together with the $-C(R^2)=C(R^3)-N<$, and $R^0$, $R^1$, $R^2$ and $R^3$ each represent a hydrogen atom or a substituent.

With respect to a detailed description and a preferable range of the groups represented by $X^4$ to $X^7$, Ar, and Z in formulas (I-3 ) to (I-5), the description in the relevant range described for formulas (I-1) and (I-2) is applied. When $R^0$ to $R^3$ represent a substituent, examples include those substituents that may be possessed by $X^1$ mentioned above.

Among the couplers represented by the above mentioned formulas, particularly preferable couplers are those represented by formula (I-4) or (I-5).

The couplers represented by formulas (I-1) to (I-5) may form a dimer or higher polymer (e.g., a telomer or a polymer) by bonding at the groups represented by $X^1$ to $X^7$, Y Ar $R^0$ to, $R^3$, and Z through a divalent group or more higher polyvalent group. In that case, the number of carbon atoms may fall outside the range of the number of carbon atoms defined in the above-mentioned substituents.

Preferable examples of the couplers represented by formulas (I-1) to (I-5) are nondiffusible couplers. The term "nondiffusible couplers" refers to couplers having in the molecule a group with a molecular weight large enough to make the molecule immobilized in the layer in which the molecule is added. Generally an alkyl group having a total C-number of 8 to 30, preferably 10 to 20, or an aryl group having a total C-number of 4 to 20, is used. These nondiffusible groups may be substituted on any position in the molecule, and two or more of them may be present in the molecule.

Specific examples of the couplers represented by formulas (I-1) to (I-5)are shown below, but the present invention is not restricted to them.

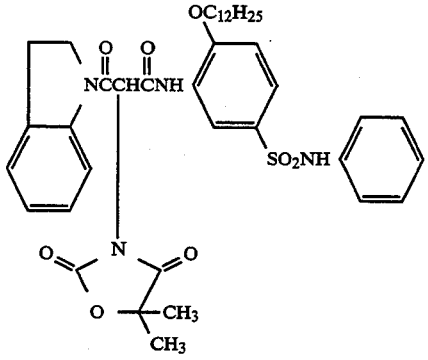

Y-1

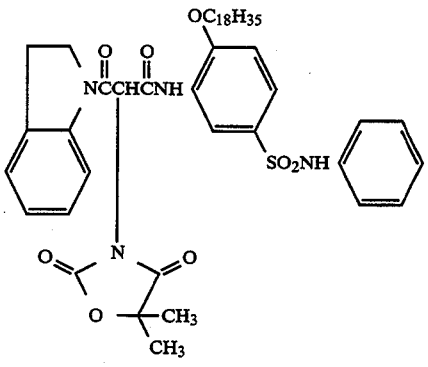

Y-2

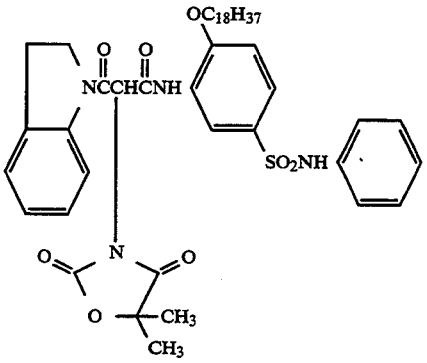

Y-3

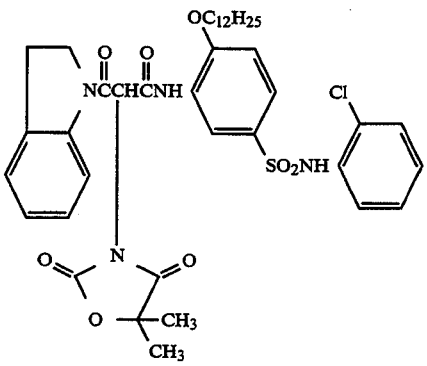

Y-4

-continued
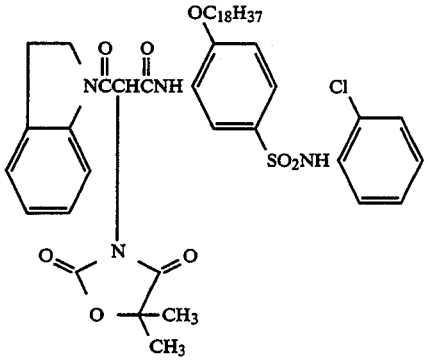
Y-5
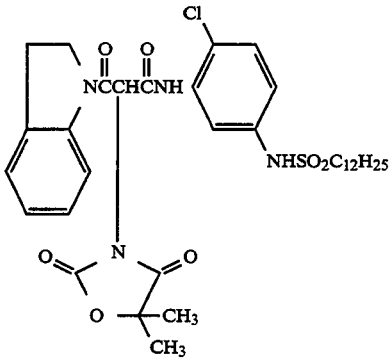
Y-6
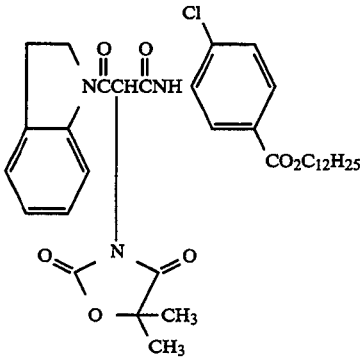
Y-7
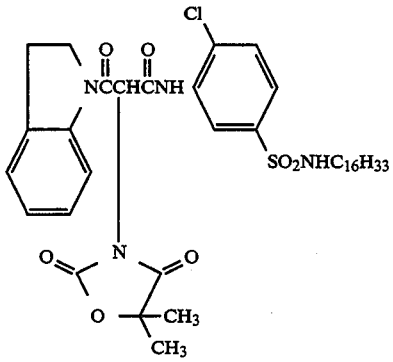
Y-8
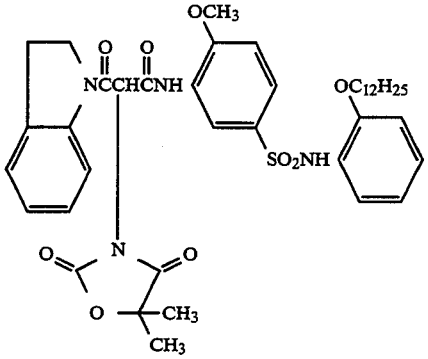
Y-9
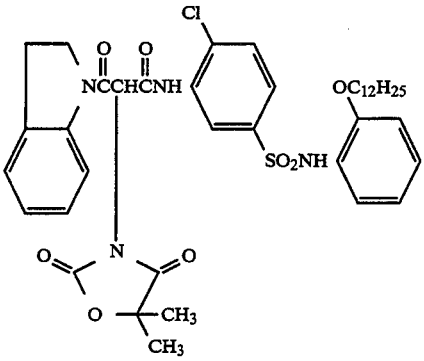
Y-10
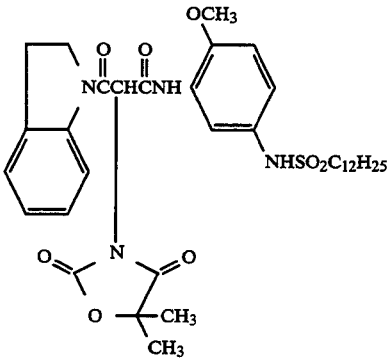
Y-11
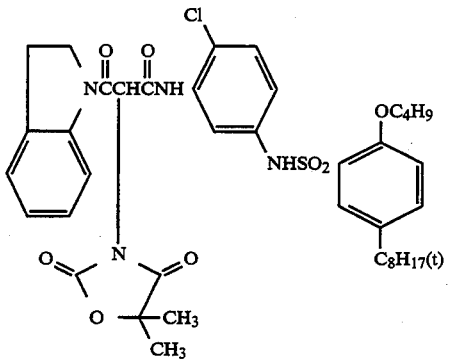
Y-12

-continued
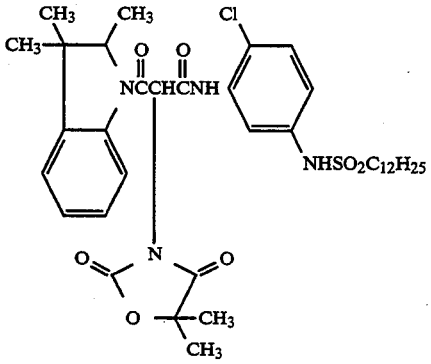
Y-13
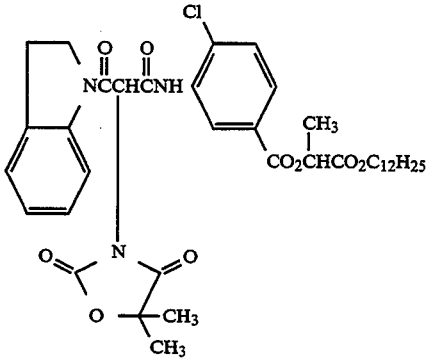
Y-14
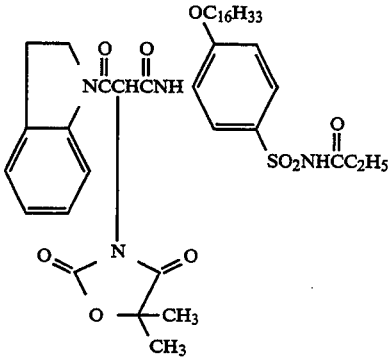
Y-15
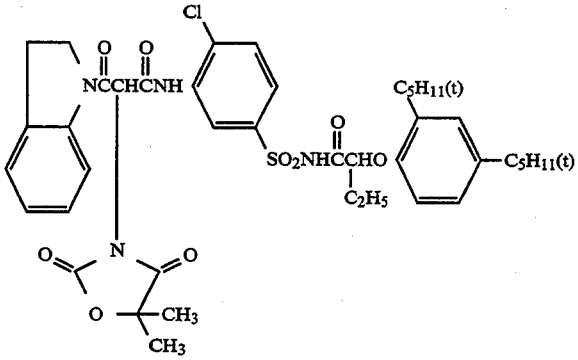
Y-16
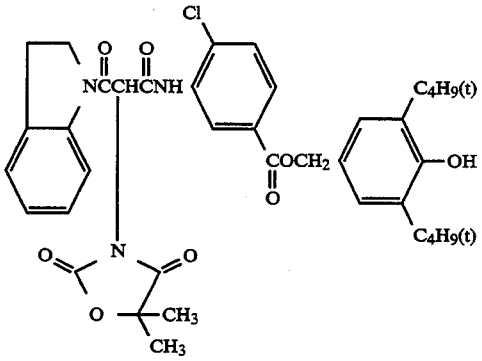
Y-17
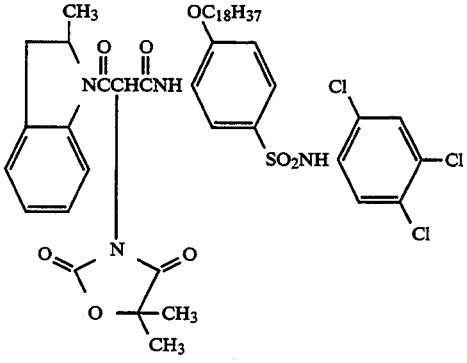
Y-18

-continued
Y-19
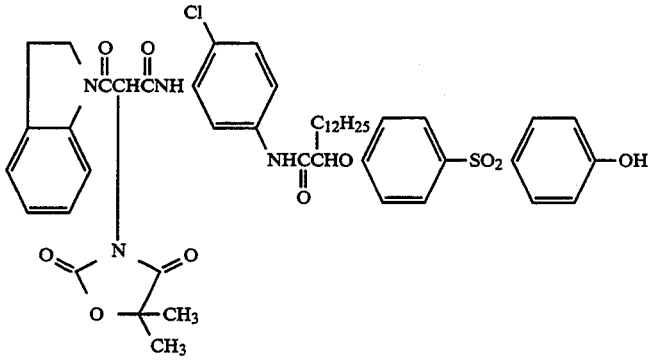
Y-20
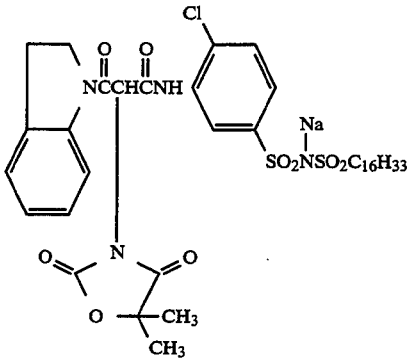
Y-21
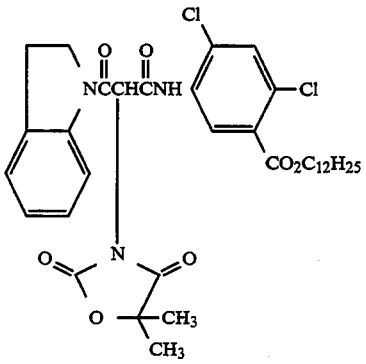
Y-22
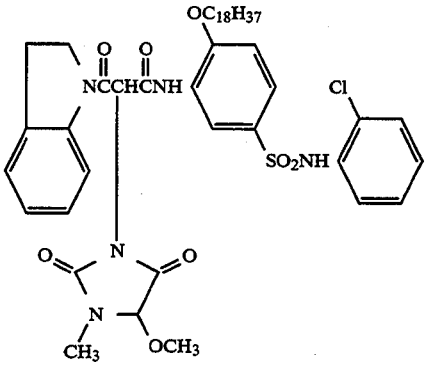
Y-23
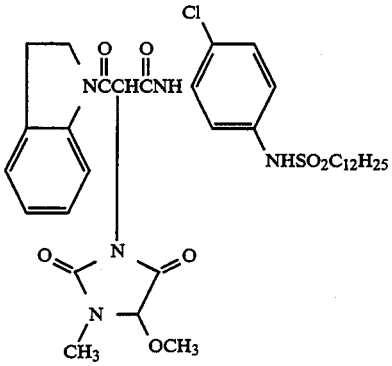
Y-24
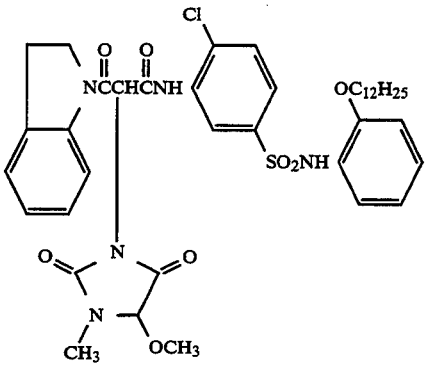
Y-25
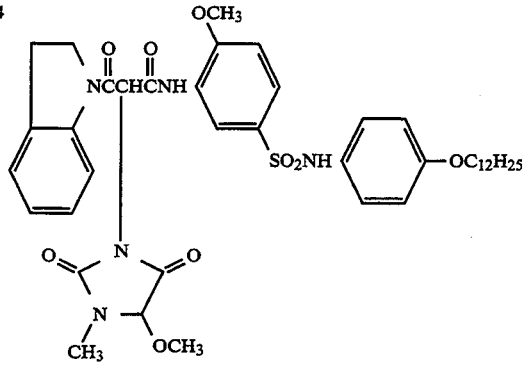

-continued
Y-26
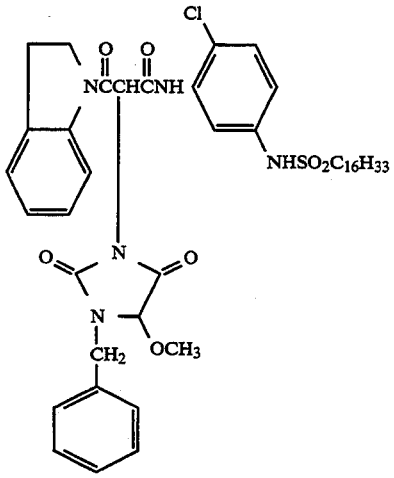
Y-27
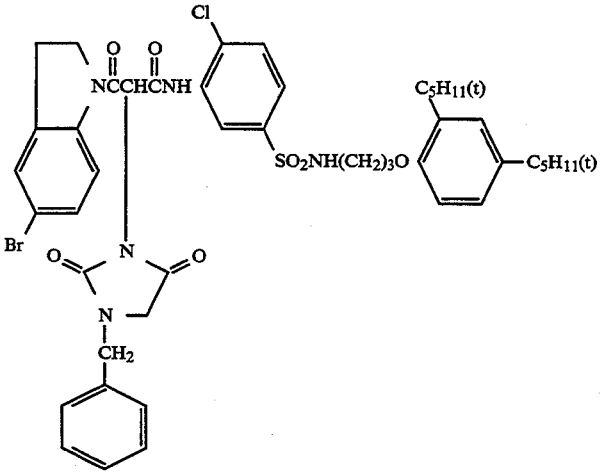
Y-28
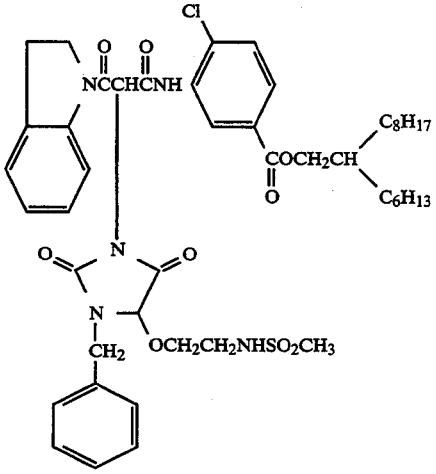
Y-29
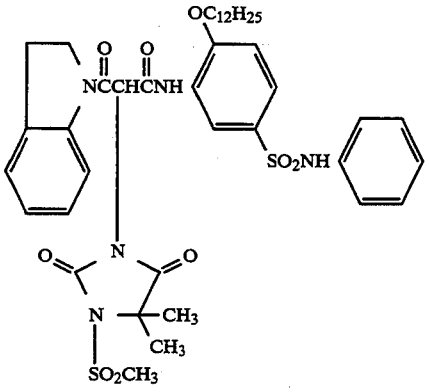

-continued
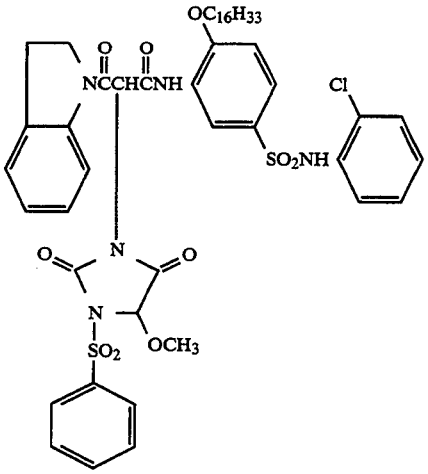
Y-30
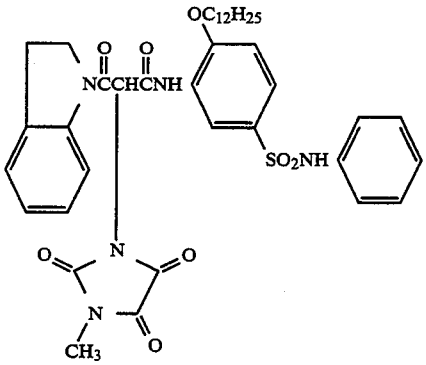
Y-31
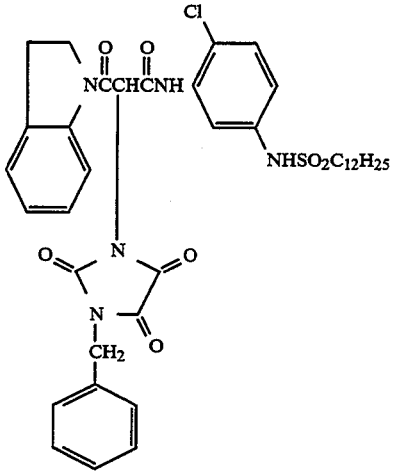
Y-32
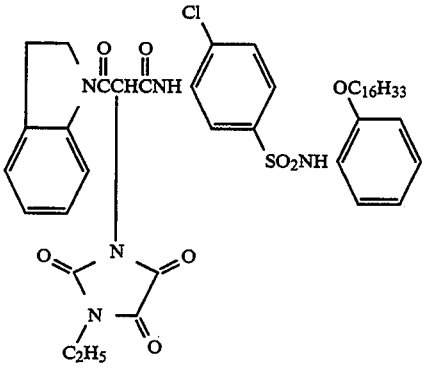
Y-33
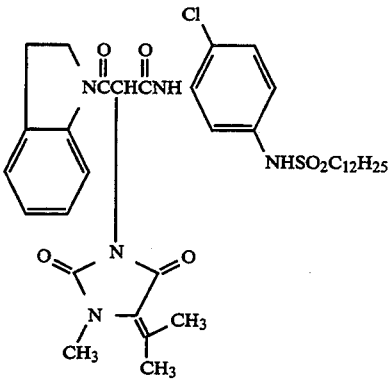
Y-34
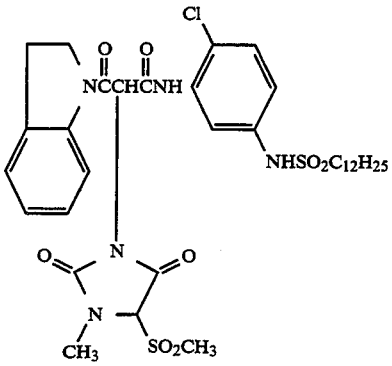
Y-35

-continued
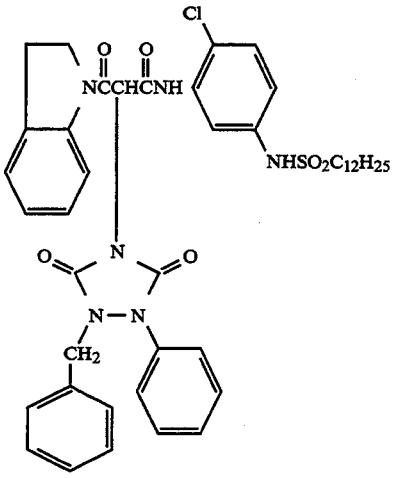
Y-36
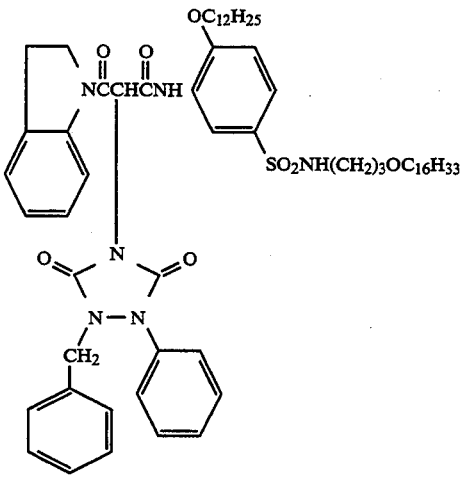
Y-37
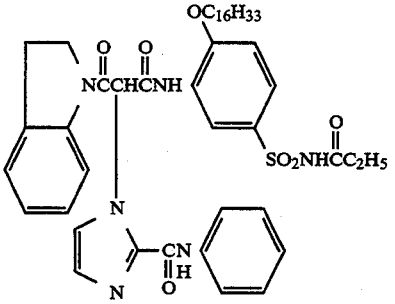
Y-38
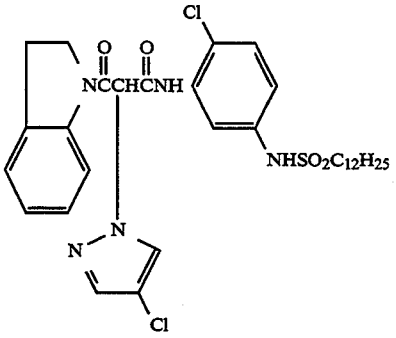
Y-39
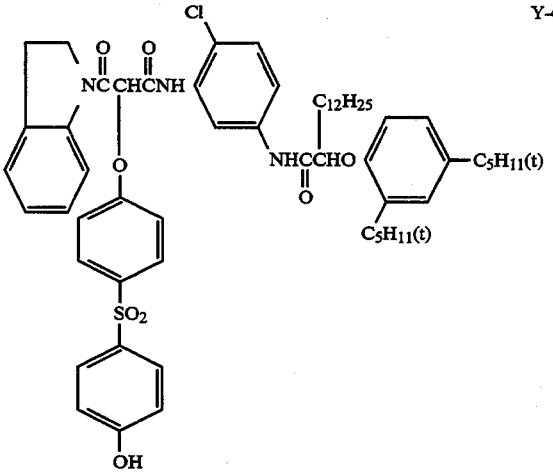
Y-40
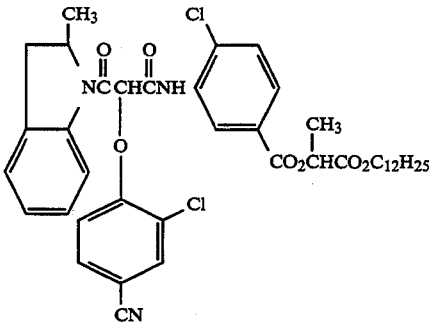
Y-41

-continued
Y-42
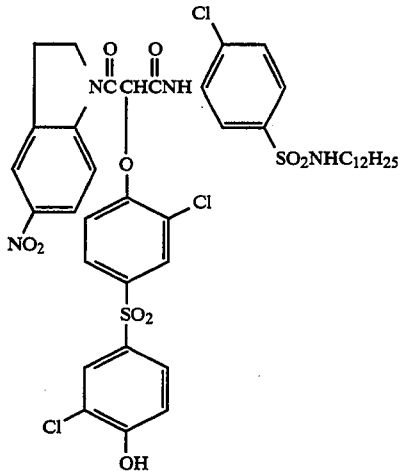
Y-43
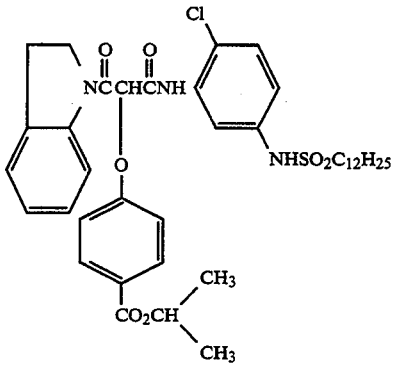
Y-44
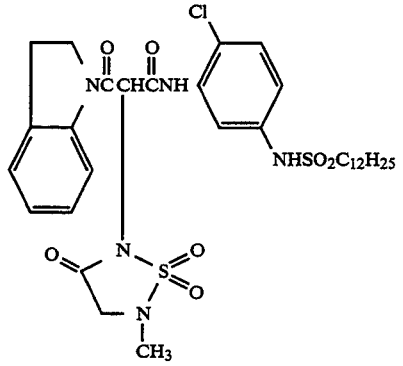
Y-45
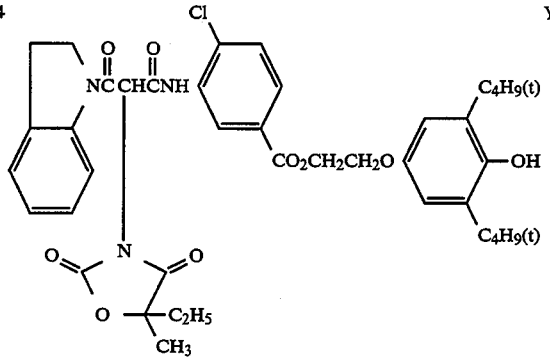
Y-46
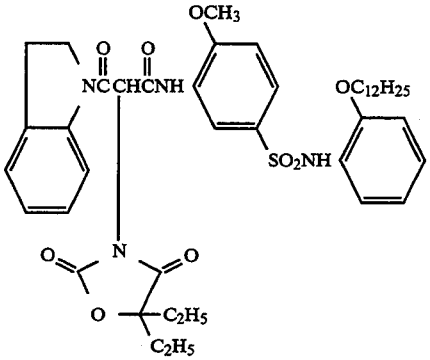
Y-47
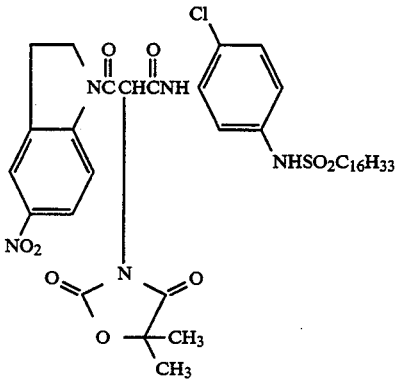
Y-48
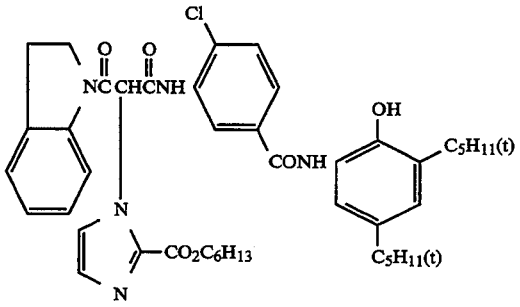
Y-49
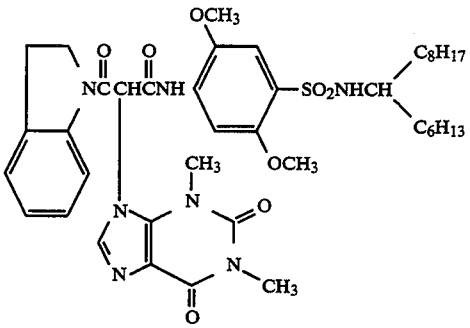

-continued
Y-50
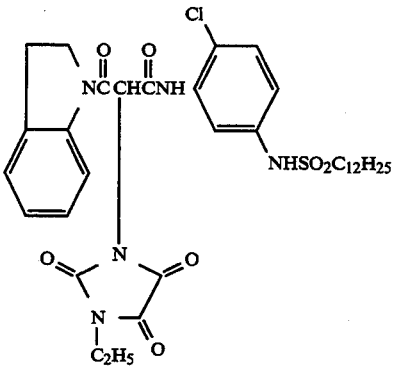
Y-51
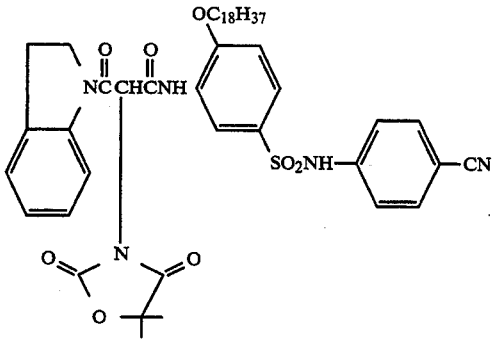
Y-52
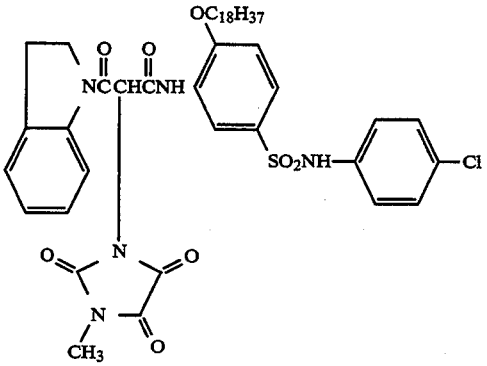
Y-53
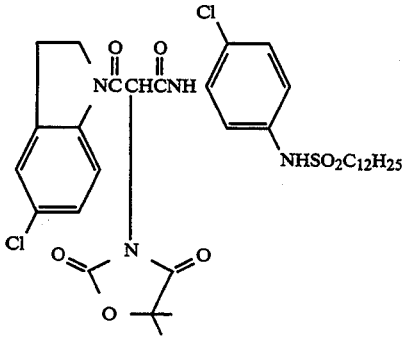
Y-54
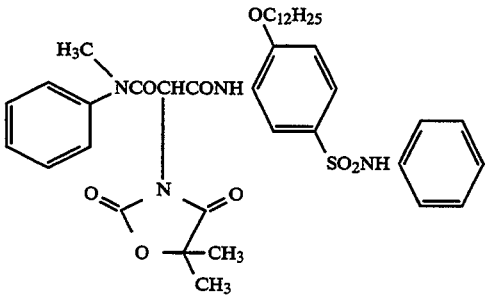
Y-55
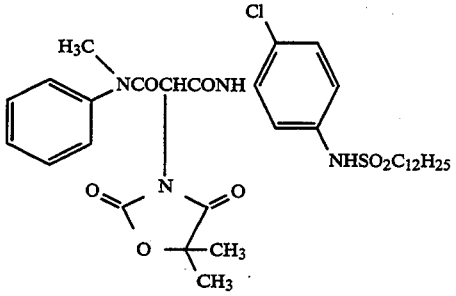
Y-56
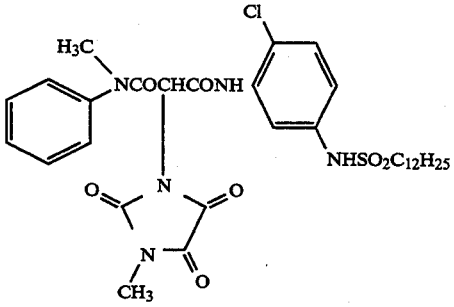
Y-57
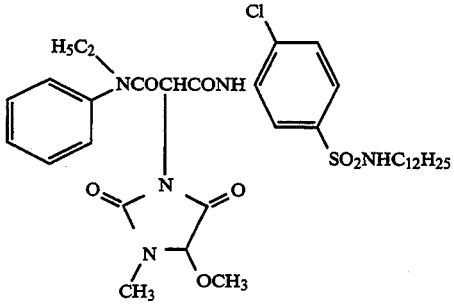
Y-58
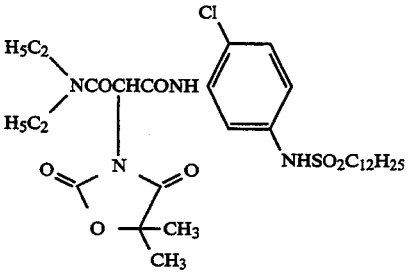
Y-59
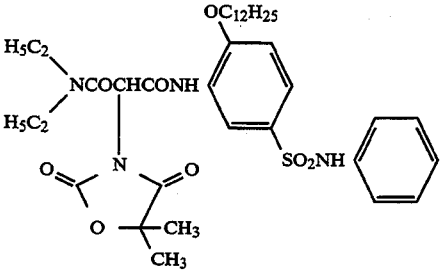

-continued
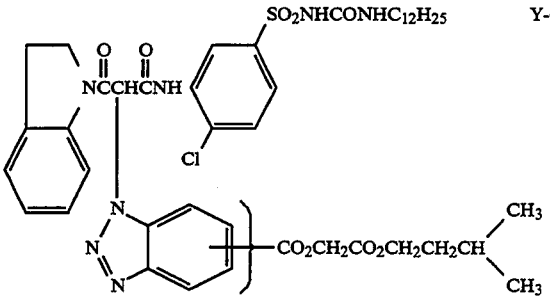
Y-60
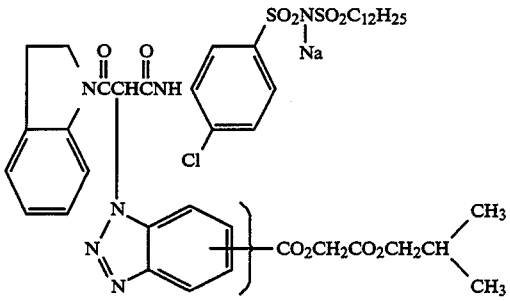
Y-61
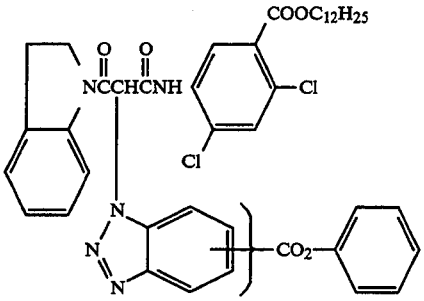
Y-62
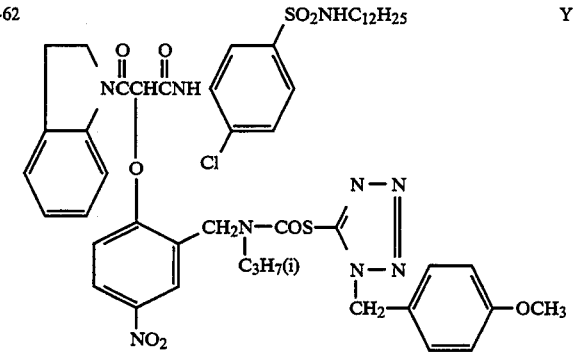
Y-63
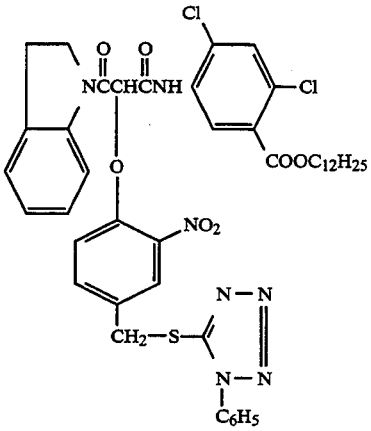
Y-64
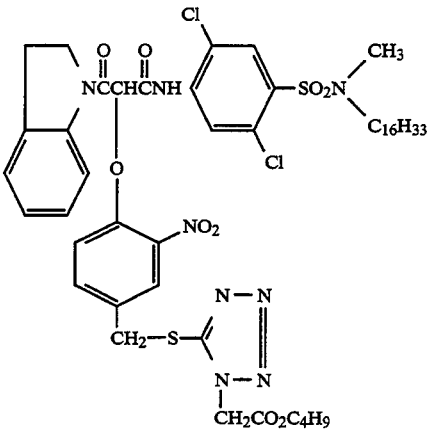
Y-65
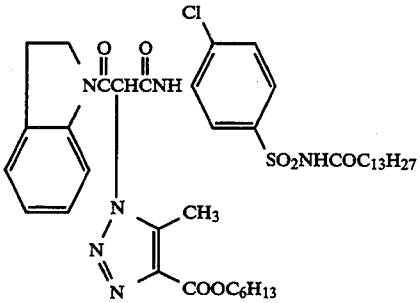
Y-66
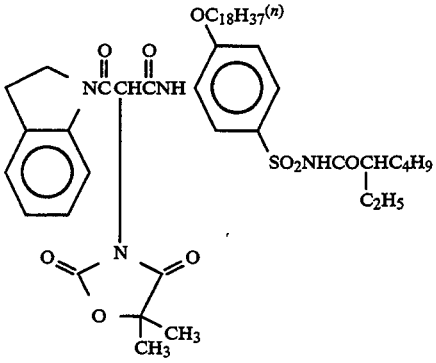
Y-67

-continued
Y-68
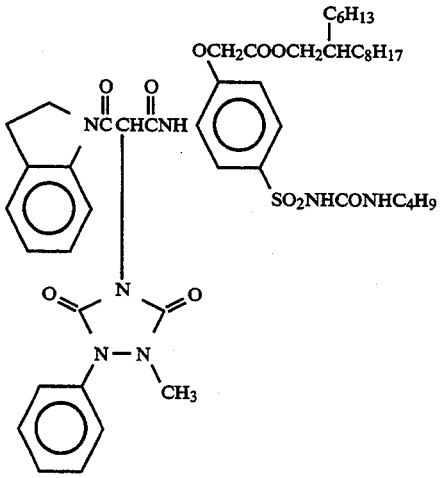
Y-69
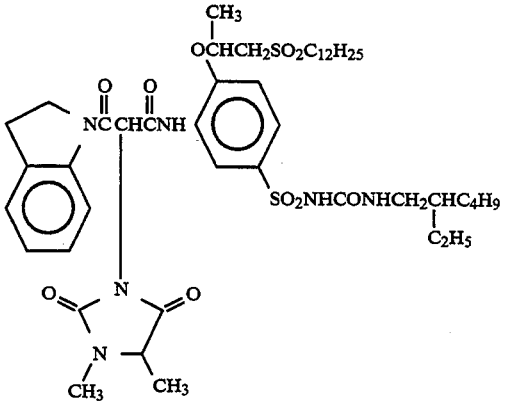
Y-70
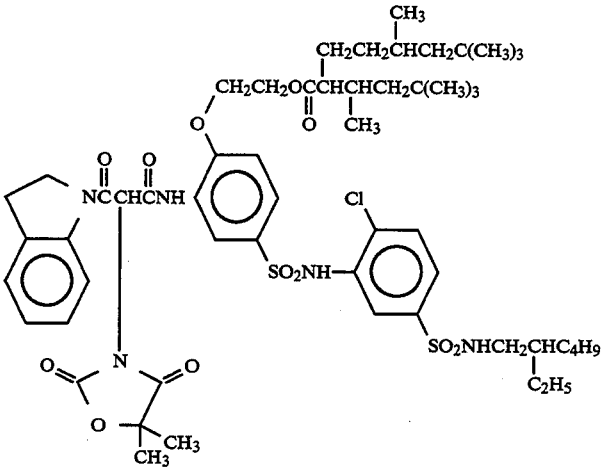
Y-71
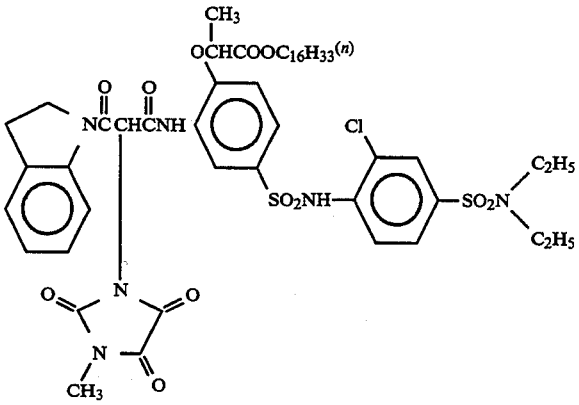

-continued
Y-72
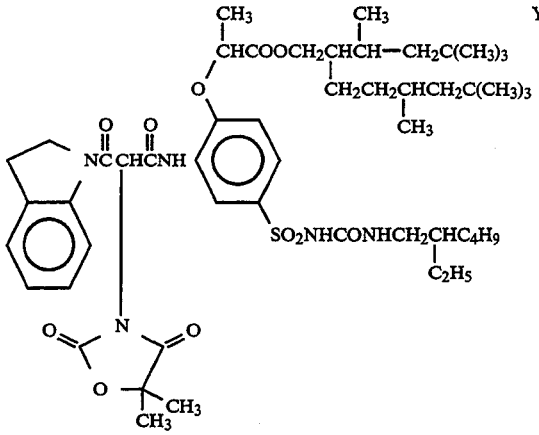
Y-73
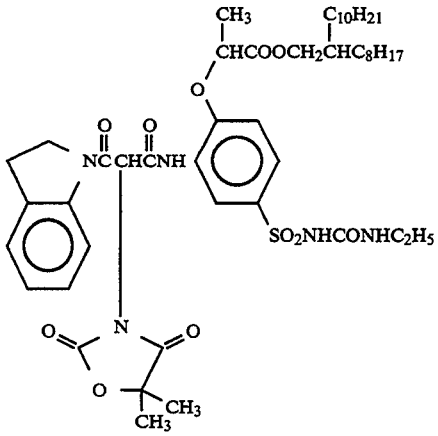
Y-74
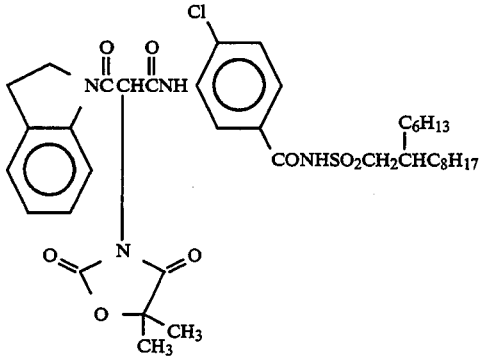
Y-75
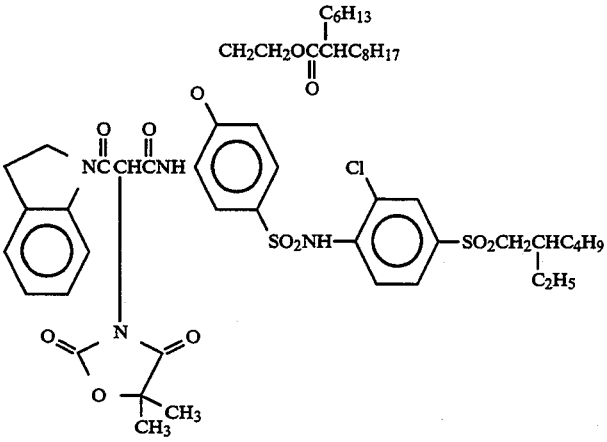
Y-76
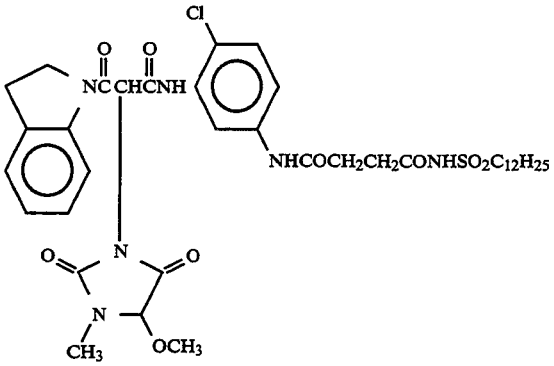
Synthesis examples of compounds represented by formulas (I-1) and (I-2) are shown below. Synthesis example 1

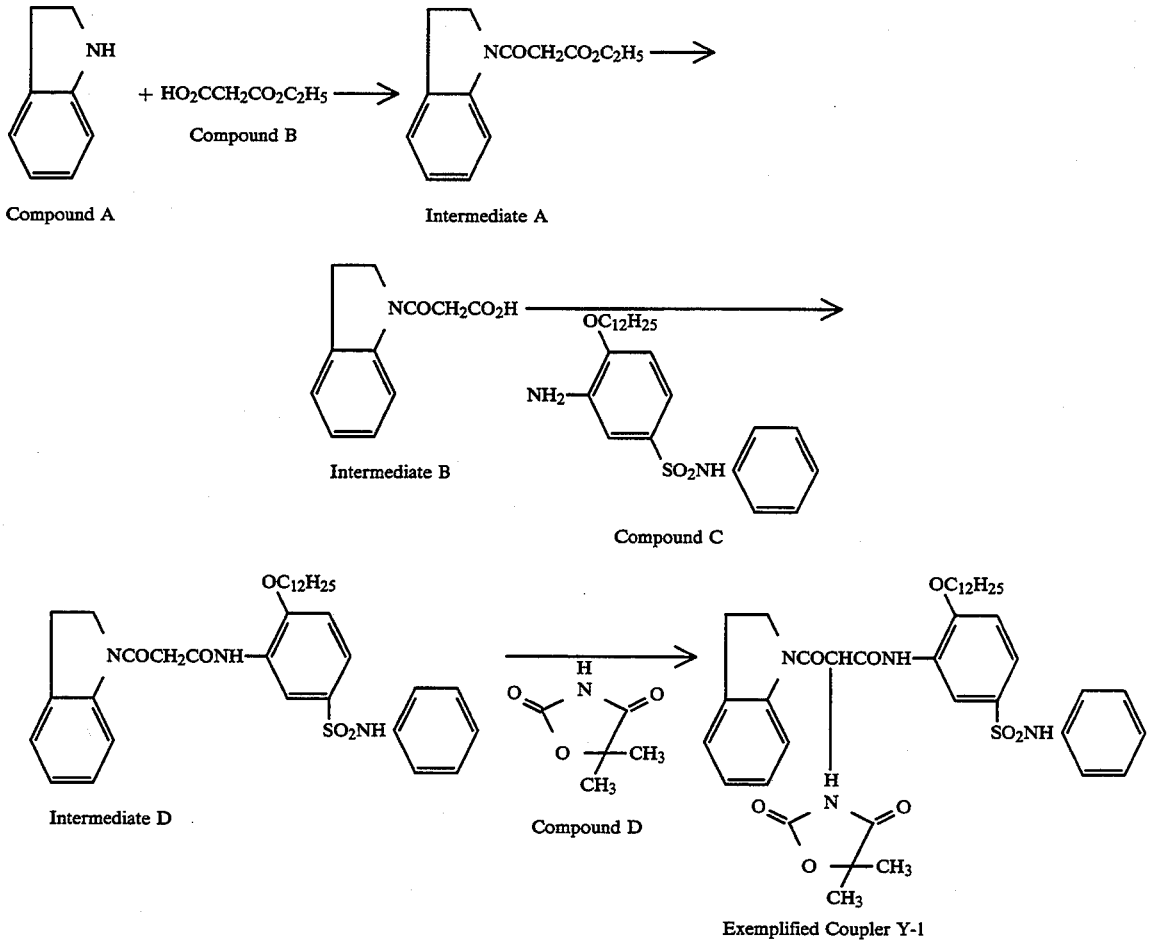

Synthesis of Intermediate B 357.5 Grams (3.0 mol) of Compound A and 396.3 g (3.0 mol) of Compound BA were dissolved in 1.2 liters of ethyl acetate and 0.6 liters of dimethylformamide. To the resulting solution, a solution of 631 g (3.06 mol) of dicyclohexylcarbodiimide in acetonitrile (400 ml) was added dropwise at 15° to 35° C. with stirring. After reacting for 2 hours at 20° to 30° C., the deposited dicyclohexyl urea was filtered off.

500 Milliliters of ethyl acetate and 1 liter of water were added to the filtrate and the water layer was removed. Then, the organic layer was washed twice with 1 liter of water each time. After the organic layer was dried over anhydrous sodium sulfate, the ethyl acetate was distilled off under reduced pressure, to obtain an oil of 692 g (98.9%) of Intermediate A.

692 Grams (2.97 mol) of the Intermediate A were dissolved in 3 liters of ethyl alcohol and, to the resulting solution, 430 g of 30% sodium hydroxide were added dropwise at 75° to 80° C. with stirring. After the addition, the reaction was continued for 30 min at the same temperature and the deposited crystals were filtered yield. 658 g)

The crystals were suspended in 5 liters of water and 300 ml of concentrated hydrochloric acid was added dropwise to the suspension at 40° to 50° C. After stirring for 1 hour at the same temperature, the crystals were filtered to obtain 579 g (95%) of Intermediate B (decomposition point: 127° C.).

Synthesis of Intermediate D 45.1 Grams (0.22 mol) of the Intermediate B and 86.6 g (0.2 mol) of Compound C were dissolved in 400 ml of ethyl acetate and 200 ml of dimethylacetamide. To the solution, a solution of 66 g (0.32 mol) of dicyclohexylcarbodiimide in acetonitrile (100 ml) was added dropwise with stirring. After reacting for 2 hours at 20° to 30° C. the deposited dicyclohexyl urea was filtered off.

400 Milliliters of ethyl acetate and 600 ml of water were added to the filtrate, and after the water layer was removed, the organic layer was washed with water twice. After the organic layer was dried over anhydrous sodium sulfate, the ethyl acetate was distilled off, to obtain 162 g of an oil.

This oil was crystallized from 100 ml of ethyl acetate and 300 ml of n-hexane, to obtain 108 g (87.1%) of Intermediate D. (melting point: 132° to 134° C.)

| Elemental analysis of Intermediate D | | | |
|---|---|---|---|
| | C % | H % | N % |
| Calculated | 67.82 | 7.32 | 6.78 |
| Found | 67.81 | 7.32 | 6.76 |

Synthesis of Exemplified Coupler Y-1

49.6 Grams (0.08 mol) of the Intermediate D were dissolved in 300 ml of dichloromethane. To the solution, 11.4 g (0. 084 mol) of sulfuryl chloride were added dropwise at 10° to 15° C. with stirring.

After reacting for 30 min at the same temperature, 200 g of a 5% aqueous sodium bicarbonate solution were added dropwise to the reaction mixture. After the organic layer was separated, it was washed with 200 ml of water and dried over anhydrous sodium sulfate. The dichloromethane was distilled off under reduced pressure, to obtain 47 g of an oil.

47 Grams of this oil were dissolved in 200 ml of acetonitrile and, to the solution, 28.4 g (0.22 mol) of Compound D and 22.2 g (0.22 mol) of triethylamine were added with stirring. After reacting for 4 hours at 40° to 50° C., the reaction mixture was poured into 300 ml of water, and the deposited oil was extracted with 300 ml of ethyl acetate. The organic layer was washed with 200 g of 5% aqueous sodium hydroxide solution and then twice with 300 ml of water each time. After the organic layer was acidified with diluted hydrochloric acid, the organic layer was washed with water twice and was concentrated under reduced pressure, to obtain a residue (yield: 70 g).

The obtained oily substance was crystallized from 50 ml of ethyl acetate and 100 ml of n-hexane, to obtain 47.8 g (80%) of Exemplified Coupler Y-1. (melting point: 145° to 147° C.)

Elemental analysis of Exemplified Coupler Y-1

| | C % | H % | N % |
|---|---|---|---|
| Calculated | 64.32 | 6.75 | 7.50 |
| Found | 64.31 | 6.73 | 7.50 |

Synthesis example 2

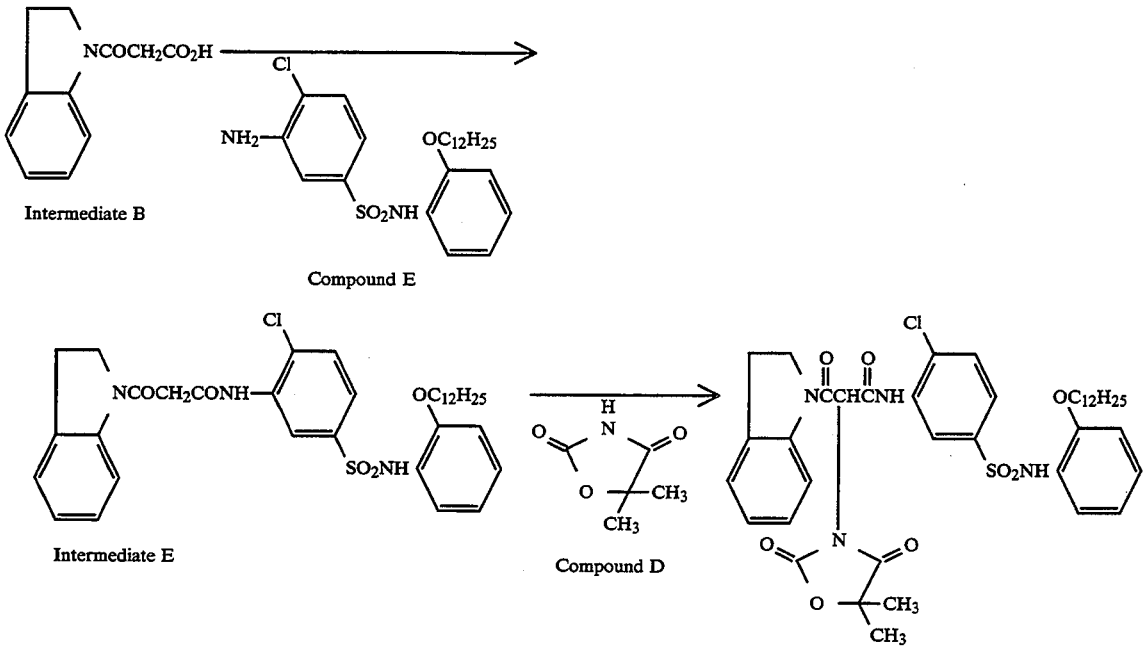

Synthesis of Intermediate E 90.3 Grams (0.44 mol) of the Intermediate B and 187 g (0.4 mol) of Compound E were dissolved in 500 ml of ethyl acetate and 300 ml of dimethylformamide. To the solution, a solution of 131.9 g (0.64 mol) of dicyclohexylcarbodiimide in acetonitrile (200 ml) was added dropwise at 15° to 30° C. with stirring.

After reacting for 2 hours at 20° to 30° C., the deposited dicyclohexyl urea was filtered off. To the filtrate, 500 ml of ethyl acetate and 600 ml of water were added, and after the water layer was removed, the organic layer was washed with water twice. After the organic layer was dried over anhydrous sodium sulfate, the ethyl acetate was distilled off under reduced pressure, to obtain 281 g of an oil. The oil was dissolved in 1.5 liters of n-hexane by heating, and undissolved matter was filtered and removed. The n-hexane solution was cooled with water, and the deposited Intermediate E was filtered. The yield was 243.4 g (93%) and the melting point was 103° to 105° C.

Elemental analysis of Intermediate E

| | C % | H % | N % |
|---|---|---|---|
| Calculated | 64.25 | 6.78 | 6.42 |
| Found | 64.24 | 6.76 | 6.43 |

Synthesis of Exemplified Coupler Y-10

39.3 Grams (0.06 mol) of the Intermediate E were dissolved in 200 ml of dichloromethane. To the solution, 8.7 g (0.064 mol) of sulfuryl chloride were added dropwise at 10° to 15° C. with stirring.

After reacting for 30 min at the same temperature, 200 g of a 4% aqueous sodium bicarbonate solution were added dropwise to the reaction mixture. After the organic layer was separated, it was washed with 200 ml of water and dried over anhydrous sodium sulfate. The dichloromethane was distilled off under reduced pressure, to obtain 41.3 g of an oil.

41.3 Grams of this oil were dissolved in 100 ml of acetonitrile and 200 ml of dimethylacetamide and, to the solution, 20.8 g (0.16 mol) of Compound D and 16.2 g of triethylamine were added with stirring. After reacting for 3 hours at 30° to 40° C., the reaction mixture was poured into 400 ml of water, and the deposited oil was extracted with 300 ml of ethyl acetate. The organic layer was washed with 300 g of 2% aqueous sodium hydroxide solution, and then with water twice. Then after the organic layer was acidified with diluted hydrochloric acid, the organic layer was washed with water twice and was concentrated under reduced pressure, to obtain 42 g of a residue.

The residue was crystallized from 200 ml of methanol, to obtain 39.8 g (85%) of Exemplified Coupler Y-10. (melting point: 110° to 112° C.)

Elemental analysis of Exemplified Coupler Y-10

| | C % | H % | N % |
|---|---|---|---|
| Calculated | 61.48 | 6.32 | 7.17 |
| Found | 61.46 | 6.30 | 7.18 |

Synthesis Example 3

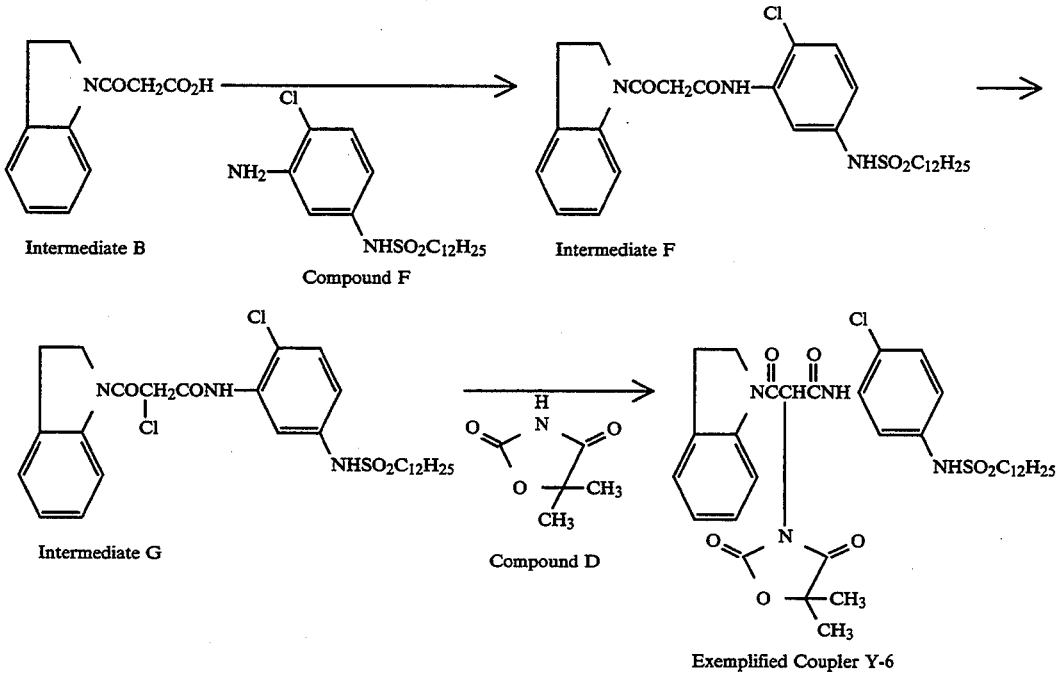

Synthesis of Intermediate F 104.7 Grams (0.51 mol) of the Intermediate B and 187.5 g (0.5 mol) of Compound F were dissolved in 1 liter of ethyl acetate and 400 ml of dimethylformamide. To the solution, a solution of 107.3 g (0.525 mol) of dicyclohexylcarbodiimide in dimethylformamide (100 ml) was added dropwise at 15° to 30° C. with stirring.

After reacting for 1 hour at 20° to 30° C., 500 ml of ethyl acetate were added; then the reaction mixture was heated to 50° to 60° C. and dicyclohexyl urea was filtered off.

To the filtrate, 600 ml of water were added, and after the water layer was removed, washing with water was carried out twice. After the organic layer was dried over anhydrous sodium sulfate, the ethyl acetate was distilled off under reduced pressure, to obtain 290 g of an oil. The oil was heated together with 1 liter of ethyl acetate and 2 liters of methanol; then undissolved matter was filtered and removed, and upon cooling of the filtrate with water, crystals of Intermediate F deposited, which were filtered. The yield was 267 g (95%) and the melting point was 163° to 164° C.

Elemental analysis of Intermediate F

| | C % | H % | N % |
|---|---|---|---|
| Calculated | 61.95 | 7.17 | 7.48 |
| Found | 67.93 | 7.17 | 7.46 |

Synthesis of Intermediate G 114.0 Grams (0.2 mol) of the Intermediate G were dissolved in 500 ml of dichloromethane. To the solution, 28.4 g (0.21 mol) of sulfuryl chloride was added dropwise at 10° to 15° C. with stirring.

After reacting for 30 min at the same temperature, 500 g of a 6% aqueous sodium bicarbonate solution were added dropwise to the reaction mixture. After the organic layer was separated, it was washed with 500 ml of water and dried over anhydrous sodium sulfate. The dichloromethane was distilled off under reduced pressure, to deposit crystals of Intermediate G, which were filtered. Yield: 108.6 g (91%)

Synthesis of Exemplified Coupler Y-6

29.8 Grams (0.05 mol) of the Intermediate G were dissolved in 80 ml of dimethylformamide, 12.9 g (0.1 mol) of Compound D were added to the solution, and then 10.1 g (0.01 mol) of triethylamine were added dropwise thereto at 20° to 30° C. with stirring. After reacting at 40° to 45° C. for 1 hour, 300 ml of ethyl acetate and 200 ml of water were added to the reaction mixture.

After the organic layer was washed twice with 400 g of 2% aqueous sodium hydroxide solution, the organic layer was washed with water once. After the organic layer was acidified with diluted hydrochloric acid, the organic layer was washed with water twice and was concentrated, to obtain 24 g of a residue. The residue was crystallized from a mixed solvent of 50 ml of ethyl acetate and 150 ml of n-hexane, to obtain 19 g of Exemplified Coupler Y-106.

The crystals were recrystallized from 120 ml of a mixed solvent of ethyl acetate/n-hexane (⅓ in vol/vol), to obtain 15 g (43.5%) of Exemplified Coupler Y-6. (melting point: 135° to 136° C.)

| Elemental analysis of Exemplified Coupler Y-6 | | | |
|---|---|---|---|
| | C % | H % | N % |
| Calculated | 59.24 | 6.58 | 8.13 |
| Found | 59.27 | 6.56 | 8.12 |

Synthesis Example 4

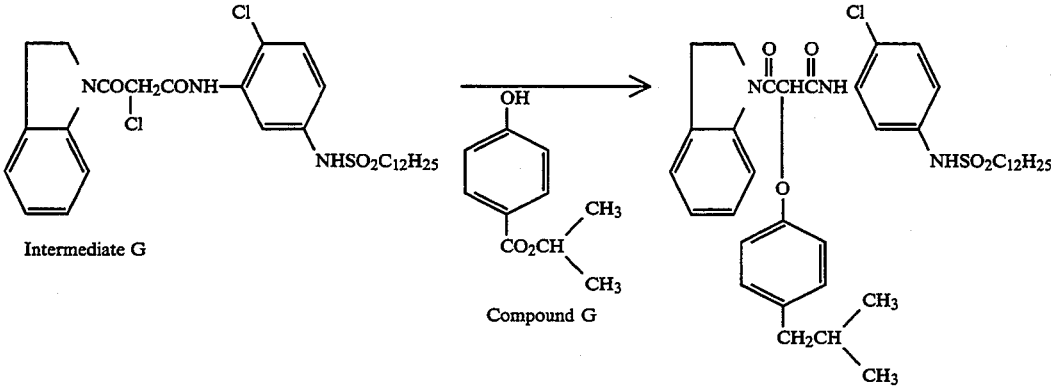

Synthesis Example Y-43

27.0 Grams (0.15 mol) of the Intermediate G and 15.2 g (0.15 mol ) of triethylamine were dissolved in 50 ml of dimethylformamide. To this mixture, a solution of 9.8 g (0.005 mol) of the Intermediate G in dimethylformamide (30 ml) was added dropwise with stirring.

After reacting for 4 hours at 30° to 40° C., 400 ml of ethyl acetate and 300 ml of water were added to the reaction mixture. The organic layer was washed twice with 400 g of 2% aqueous sodium hydroxide solution and then with water twice. After the organic layer was acidified with diluted hydrochloric acid, the organic layer was washed with water twice and was dried over anhydrous sodium sulfate. The ethyl acetate was distilled off under reduced pressure, to obtain 54 g of a residue.

The residue was crystallized from 300 ml of a mixed solvent of ethyl acetate/methanol (½ in vol/vol) and the crystals were filtered, to obtain Exemplified Coupler Y-43. The obtained crystals were recrystallized from 200 ml of a mixed solvent of ethyl acetate/methanol (½ in vol/vol) to obtain 28.8 g (77.8%) of Exemplified Coupler Y-43. (melting point: 190° to 191° C.)

| Elemental analysis of Exemplified Coupler Y-43 | | | |
|---|---|---|---|
| | C % | H % | N % |
| Calculated | 63.26 | 6.81 | 5.68 |
| Found | 63.24 | 6.79 | 5.67 |

The epoxy compound represented by formula (II) of the present invention is now described in detail.

In formula (II), $R^4$, $R^5$, $R^6$, and R 7 each represent a hydrogen atom, an aliphatic group having 1 to 30 carbon atoms (preferably 1 to 20 carbon atoms), an aromatic group having 6 to 42 carbon atoms (preferably 6 to 30 carbon atoms), an aliphatic-oxycarbonyl group having to 31 carbon atoms (preferably 2 to 21 carbon atoms) (e.g., dodecyloxycarbonyl and allyoxycarbonyl), an aromatic-oxycarbonyl group having 7 to 43 carbon atoms (preferably 7 to 33 carbon atoms ) (e.g., phenoxycarbonyl), or a carbamoyl group having 1 to 42 carbon atoms (preferably 1 to 30 carbon atoms)(e.g., tetradecylcarbamoyl and phenylmethylcarbamoyl), provided that each of $R^4$, $R^5$, $R^6$, and $R^7$ does not represent a hydrogen atom at the same time.

Herein, the term "an aliphatic group" means a straight-chain, branched-chain, or cyclic aliphatic hydrocarbon group which may be saturated or unsaturated, such as an alkyl group, an alkenyl group, and an alkynyl group. Typical examples thereof are methyl, ethyl, butyl, dodecyl, octadecyl, iso-propyl, tert-butyl, tert-octyl, cyclohexyl, cyclopentyl, 1-methylcyclohexyl, allyl, vinyl, 2-hexadecenyl, and propargyl.

The term "an aromatic group" means a substituted or unsubstituted phenyl group or naphthyl group having 6 to 42 carbon atoms. These aliphatic group and aromatic group may be substituted by a substituent(s), for example, selected from an alkyl group, an aryl group, a heterocyclic group, an alkoxy group (e.g., methoxy and 2-methoxyethoxy), an aryloxy group (e.g., 2,4-di-tert-amylphenoxy, 2-chlorophenoxy, and 4-cyanophenoxy), an alkenyloxy group (e.g., 2-propenyloxy), an acyl group (e.g., acetyl and benzoyl), an ester group (e.g., butoxycarbonyl, phenoxycarbonyl, acetoxy, benzoyloxy, butoxysulfonyl, and toluenesulfonyloxy), an amido group (e.g., acetylamino, ethylcarbamoyl, dimethylcarbamoyl, methanesulfonamido, and butylsulfamoyl), a sulfamido group (e.g., dipropylsulfamoylamino), an imido group (e.g., succinimido and hydantoinyl), a ureido group (e.g., phenylureido and dimethylureido), an aliphatic or aromatic sulfonyl group (e.g., methanesulfonyl and phenylsulfonyl), an aliphatic or aromatic-thio group (e.g., ethylthio and phenylthio), a hydroxyl group, a cyano group, a carboxyl group, a nitro group, a sulfo group, and a halogen atom.

Specific examples of the compound of the present invention represented by formula (II) are shown below, but the present invention is not restricted to them.

E-1
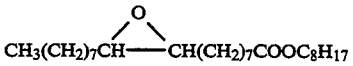
E-2
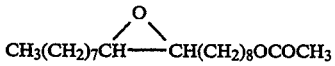
E-3
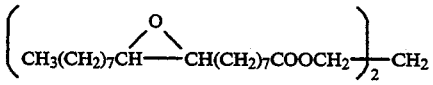
E-4
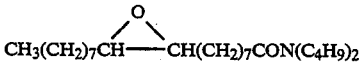
E-5
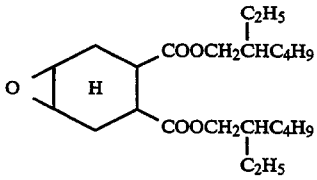
E-6
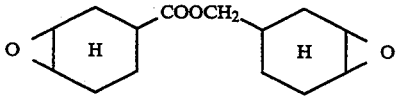
E-7
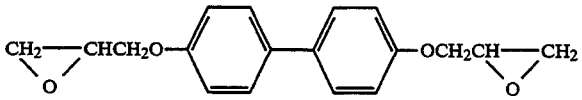
E-8
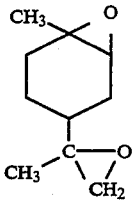
E-9
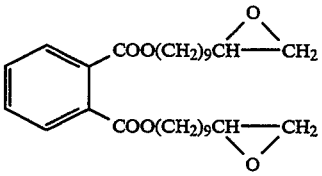
E-10
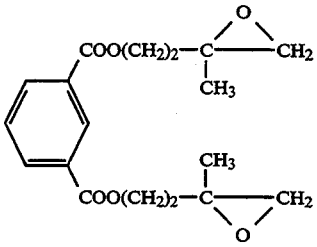
E-11
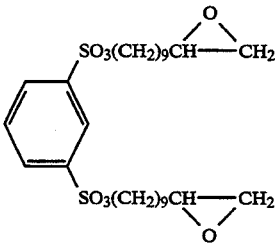
E-12
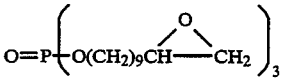
E-13
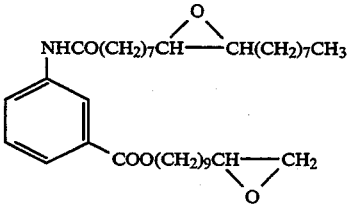
E-14
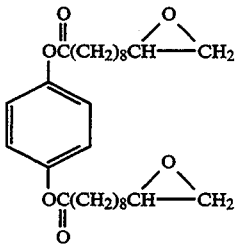
E-15
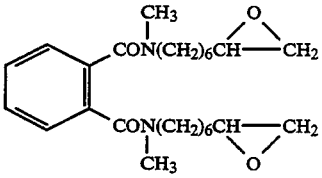
E-16
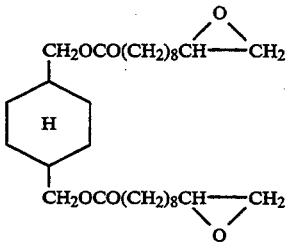
E-17
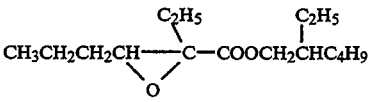

-continued

E-18

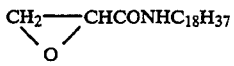

E-19

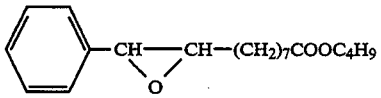

E-20

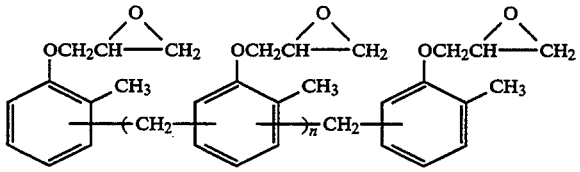

Mixture of n = 0 to 7

E-21

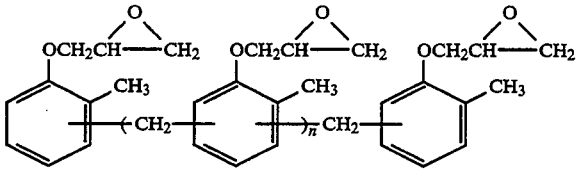

Mixture of n = 3 to 12

E-22

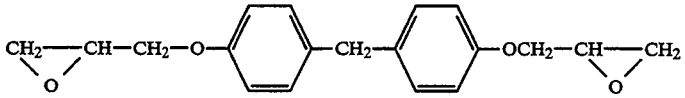

E-23

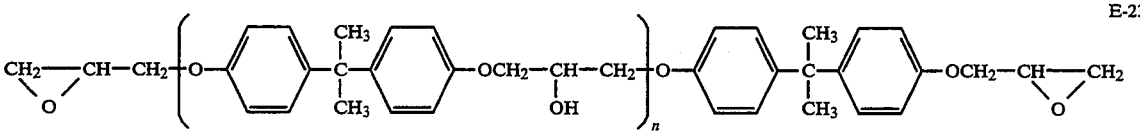

Mixture of n = 0 to 7

E-24

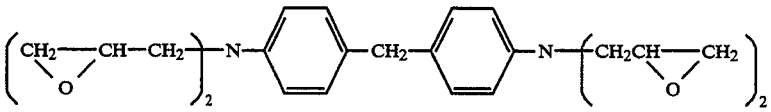

E-25

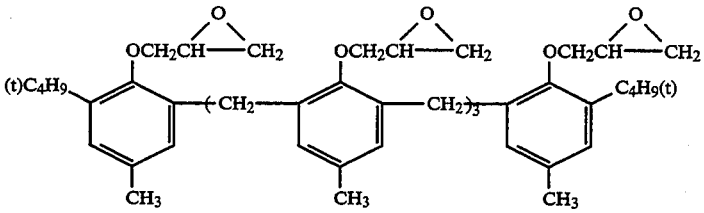

E-26

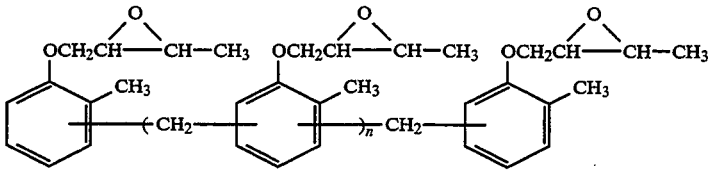

Mixture of n = 0 to 7

The amide compound represented by formula (III) will now be described in detail below.

In formula (III ), $R^8$, $R^9$, and $R^{10}$ each represent an alkyl group having preferably 1 to 36 carbon atoms or an aryl having 6 to 36 carbon atoms which may be substituted by a substituent(s) such as a halogen atom, an alkoxy group, an aryl group, an aryloxy group, an alkylsulfonyl group, an arylsulfonyl group, an alkoxycarbonyl group, and a carbamoyl group. Where $R^9$ and $R^{10}$ each represent an alkyl group, the alkyl groups may bond together to form a 5- to 7-membered ring.

Among the compounds represented by formula (III ), compounds represented by the following formula (IV) are particularly preferable.

formula (IV)

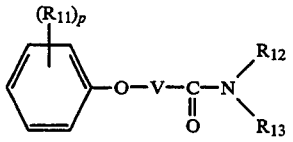

wherein $R^{11}$ represents a halogen atom (e.g., fluorine, chlorine, bromine, and iodine), an alkyl group having 1 to 24 carbon atoms (e.g., methyl, ethyl, iso-propyl, tert-butyl, tert-pentyl, cyclopentyl, cyclohexyl, 1,3,3-tetramethylpropyl, n-decyl, n-pentadecyl, and tert-pentadecyl), or an alkoxy group having 1 to 24 carbon atoms (e.g., methoxy, ethoxy, butoxy, octyloxy, benzyloxy, and dodecyloxy), $R^{12}$ and $R^{13}$ each independently represent a hydrogen atom or an alkyl group having 1 to 24 carbon atoms (e.g., methyl, ethyl, isopropyl, tert-butyl, methoxyethyl, benzyl, 2-ethylhexyl, n-hexyl, n-decyl, and n-dodecyl), V represents an alkylene group having 1 to 24 carbon atoms (e.g., methylene, ethylene, trimethylene, ethylidene, and propylidene), p is an integer of 1 to 3, when p is an integer of 2 or 3, the $R_{11}$ groups may be the same or different, and $R^{12}$ and $R^{13}$ may bond together to form a 5- to 7-membered ring.

Specific examples of the amide compound represented by formula (III) are shown below, but the present invention is not restricted to them.

These amide compounds can be synthesized in conventionally known manner, for example, by the condensation reaction of a carboxylic acid anhydride or a carboxylic acid chloride with an amine. Specific synthesis examples are described, for example, in JP-B ("JP-B" means examined Japanese patent publication) No. 25260/1983, JP-A No.25414/1987, and U.S. Pat. No. 4,171,975.

A-1

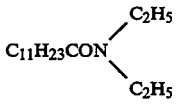

A-2

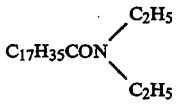

A-3

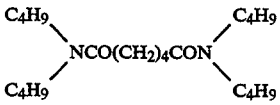

A-4

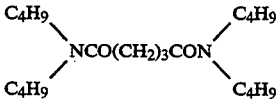

A-5

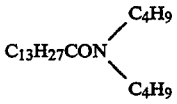

A-6

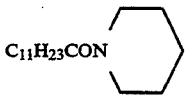

-continued

A-7

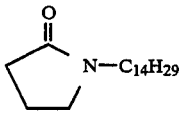

A-8

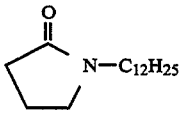

A-9

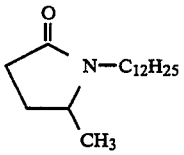

A-10

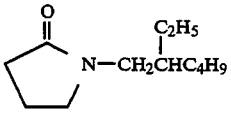

A-11

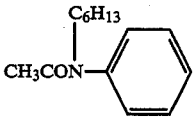

A-12

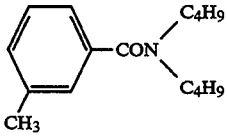

A-13

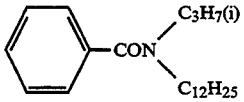

A-14

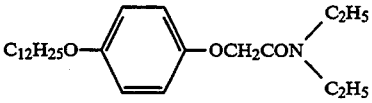

A-15

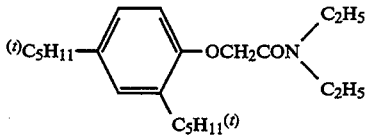

A-16

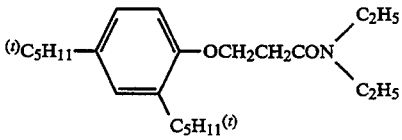

A-17

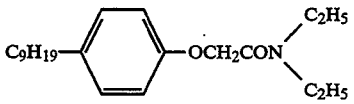

A-18

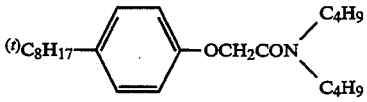

-continued

A-19

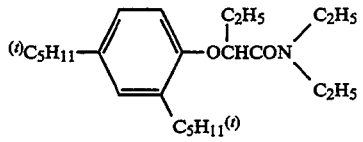

A-20

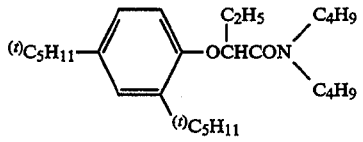

A-21

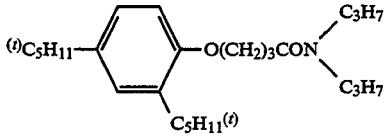

A-22

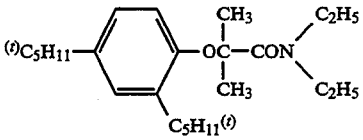

The amount of the yellow coupler represented by formula (I-1) or (I-2) to be added is preferably 0.1 to 2 mmol, more preferably 0.3 to 1.3 mmol, per square meter of silver halide color photographic material.

The amount of compound represented by formulas (II) and (III) of the present invention to be used is preferably in the range of 0.01 to 2.0 wt %, more preferably in the range of 0.1 to 1.0 wt %, based on the yellow coupler represented by formula (I-1) or (I-2).

In the present invention, the compound represented by formula (II) or (III) may be used as a solvent or a part of solvents, for the yellow coupler.

Although the cyan color-forming layer, magenta color-forming layer, and yellow color-forming layer of the present silver halide color photographic material are generally a red-sensitive emulsion layer, green-sensitive emulsion layer, and blue-sensitive emulsion layer, respectively, it is not necessarily the case corresponding to the above, and they may be, for example an infrared-sensitive emulsion layer, infrared-sensitive emulsion layer, and red-sensitive emulsion layer, respectively. Further, in the present invention, a yellow color-forming layer, among these layers, is applied at the nearest position to the support, and then a magenta color-forming layer and a cyan color-forming layer are applied thereon. With respect to the: order of application of magenta color-forming layer and cyan color-forming layer, either of them will do.

Although, as a silver halide for use in the present invention, for example, silver chloride, silver bromide, silver bromo(iodo)chloride, and silver bromoiodide can be used, particularly if rapid processing is intended, a silver chloride emulsion or a silver bromochloride emulsion substantially free from silver iodide and having a silver chloride content of 90 mol % or more, preferably 95 mol % or more, particularly preferably 98 mol % or more, is used preferably.

In the photographic material according to the present invention, in order to improve, for example,. sharpness of the image, preferably a dye that can be decolored by processing (in particular an oxonol dye), as described in European Patent EP 0,337,490A2, pages 27 to 76, is added to a hydrophilic layer, so that the optical reflection density of the photographic material at 680 nm may be 0.70 or over, or 12 wt % or more (preferably 14 wt % or more) of titaniun oxide the surface of which has been treated with secondary to quaternary alcohol (e.g., trimethylolethane) or the like is contained in a water-resistant resin layer of the support.

The present yellow coupler can be used in combination with a yellow coupler other than the present yellow coupler. In the present invention, as yellow couplers, magenta couplers, and cyan couplers, those described in the patents in Table shown below may be used. Pyrazoloazole-type couplers are particularly preferable as magenta couplers.

In the present invention, the coating amount of coupler in respective layers is preferably 0.1 to 2 mmol, more preferably 0.3 to 1.3 mmol, per square meter of silver halide color photographic material. The coating amount of silver halide emulsion in the silver halide emulsion layer is preferably 2 to 10 mol, more preferably 2 to 5 tool (in terms of Ag atom), per tool of coupler.

As a high-boiling organic solvent for photographic additives, such as cyan, magenta, and yellow couplers that can be used in the present invention, any compound can be used if the compound has a melting point of 100° C. or below and a boiling point of 140° C. or over; if it is immiscible with water; and if it is a good solvent for the coupler. The melting point of the high-boiling organic solvent is preferably 80° C. or below and the boiling point of the high-boiling organic solvent is preferably 160° C. or over, more preferably 170° C. or over.

Details of these high-boiling organic solvents are described in JP-A No. 215272/1987, from page 137 (right lower column) to page 144 (right upper column).

The cyan, magenta, or yellow coupler can be emulsified and dispersed into a hydrophilic colloid, by impregnating into a loadable latex polymer (e.g., see U.S. Pat. No. 4,203,716) in the presence or absence of the above high-boiling organic solvent or by dissolving into a polymer insoluble in water but soluble in organic solvents.

Preferably, homopolymers and copolymers described in U.S. Pat. No. 4,857,449 and International Publication WO 88/00723, pages 12 to 30, are used, and more preferably methacrylate polymers or acrylamide polymers, particularly preferably acrylamide polymers, are used because, for example, the color image is stabilized.

In the photographic material according to the present invention, preferably together with the coupler a color image preservability-improving compound, as described in European Patent EP 0,277,589A2, is used. Particularly a combination with a pyrazoloazole coupler is preferable.

That is, when a compound (F), which will chemically combine with the aromatic amine developing agent remaining after the color development processing to form a chemically inactive and substantially colorless compound, and/or a compound (G), which will chemically combine with the oxidized product of the aromatic amine color developing agent remaining after the color development processing to form a chemically inactive and substantially colorless compound, are used simultaneously or singly, it is preferable because occurrence of stain and other side effects, for example, due to the production of a color-formed dye by reaction of the coupler with the color-developing agent or its oxidized product remaining in the film during the storage after the processing, can be prevented.

To the photographic material according to the present invention, a mildew-proofing agent described, for example, in JP-A No. 271247/1988, is preferably added in order to prevent the growth of a variety of mildews and fungi that will propagate in the hydrophilic layer and deteriorate the image thereon.

As a support to be used for the photographic material of the present invention, a white polyester support for display may be used, or a support wherein a layer containing white pigment is provided on the side that will have a silver halide layer. Further, in order to improve sharpness, preferably an anti-halation layer is applied on the side of the support where the silver halide layer is applied or on the undersurface of the support. In particular, preferably the transmission density of the base is set in the range of 0.35 to 0.8, so that the display can be appreciated through either reflected light or transmitted light.

The photographic material of the present invention may be exposed to visible light or infrared light. The method of exposure may be low-intensity exposure or high-intensity short-time exposure, and particularly in the later case, the laser scan exposure system, wherein the exposure time per picture element is less than $10^{-4}$ sec is preferable.

When exposure is carried out, the band stop filter, described in U.S. Pat. No. 4,880,726, is preferably used. Thereby light color mixing is eliminated and the color reproduction is remarkably improved.

The exposed photographic material may be subjected to conventional color development processing, and then preferably it is subjected to bleach-fix processing for the purpose of rapid processing. In particular, when the above-mentioned high-silver-chloride emulsion is used, the pH of the bleach-fix solution is preferably about 6.5 or below, more preferably about 6 or below, for the purpose of he acceleration of desilvering.

With respect to silver halide emulsions, other materials (e.g., additives) and photographic component layers (e.g., layer arrangement) that will be applied to the photographic material of the present invention, as well as processing methods and processing additives that will be applied to the photographic material of the present invention, particularly those described in below-mentioned patent publications, particularly in European Patent EP 0,355,66DA2 (JP-A No. 139544/1990), are preferably used.

| Element constituting photographic material | JP-A No. 215272/1987 | JP-A No. 33144/1990 | EP 0,355,660A2 |
|---|---|---|---|
| Silver halide emulsion | p. 10 upper right column line 6 to p. 12 lower left column line 5, and p. 12 lower right column line 4 from the bottom to p. 13 upper left column line 17 | p. 28 upper right column line 16 to p. 29 lower right column line 11 and p. 30 lines 2 to 5 | p. 45 line 53 to p. 47 line 3 and p. 47 lines 20 to 22 |
| Solvent for silver halide | p. 12 lower left column line 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing acdelerator | p. 72 lower left column line 1 to p. 91 upper right column line 3 | — | — |
| Color coupler (Cyan, Magenta, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthen agent | p. 121 upper left column line 7 to p. 125 upper right column line 1 | — | — |
| Ultra violet absorbent | p. 125 upper right column line 2 to p. 127 lower left column last line | p. 37 lower right column line 14 to p. 38 upper left column line 11 | p. 65 lines 22 to 31 |
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |

-continued

| Element constituting photographic material | JP-A No. 215272/1987 | JP-A No. 33144/1990 | EP 0,355,660A2 |
|---|---|---|---|
| High-boiling and/or low-boiling solvent | p. 137 lower left column line 9 to p. 144 upper right column last line | p. 35 lower right column line 14 to p. 36 upper left column line 4 | p. 64 lines 1 to 51 |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing Agent precursor | p. 155 lower left column line 5 to p. 155 lower right column line 2 | — | — |
| Compound releasing development restrainer | p. 155 lower right column lines 3 to 9 | — | — |
| Base | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower right column last line | p. 38 upper left column line 12 to upper right column line 7 | p. 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 1 |
| Surface-active agent | p. 201 lower left column line 1 to p. 210 upper right column last line | p. 18 upper right column line 1 to p. 24 lower right column last line and p. 27 lower left column line 10 from the bottom to lower right column line 9 | — |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid) | p. 222 lower left column line 6 to p. 225 upper left column last line | p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note:
In the cited part of JP-A No. 21572/1987, amendment filed on March 16, 1987 is included. Further, among the above-mentioned couplers, it is preferred to use so called short wavelength-type yellow coupler, described in JP-A Nos. 231451/1988, 123047/1988, 241547/1988, 173499/1989, 213648/1989, and 250944/1989, as a yellow coupler.

Further, as cyan couplers for combination use, diphenylimidazole series cyan couplers described in JP-A No. 33144/1990, as well as 3-hydroxypyridine series cyan couplers described in European Patent EP 0,333,185A2 (in particular one obtained by causing Coupler (42), which is a four-equivalent coupler, to have a chlorine coupling split-off group, thereby rendering it to two-equivalent, and Couplers (6) and (9), which are listed as specific examples, are preferable) and cyclic active methylene cyan dye-forming couplers. described in JP-A No. 32260/1990 (in particular, specific ally listed Coupler Examples 3, 8, and 34 are preferable) are preferably used.

As a method for color development processing of a photographic material using a high-silver-chloride emulsion having a silver chloride content of 90 mol % or more, the method described in, for example, JP-A No. 207250/1990, page 27 (the left upper column) to page 34 (the right upper column), is preferably used.

According to the present invention, a silver halide color photographic material excellent in color reproduction compared with the case of using a conventional yellow coupler can be obtained. Further, in the present invention, the stability of coupler emulsion is excellent, and the wet-and-heat fastness and light fastness of color image obtained are also excellent.

The present invention will be described in more detail in accordance with Examples, but the invention is not limited to these Examples.

EXAMPLE 1

A multilayer color print paper (Sample 101) having layer compositions shown below was prepared on a paper support laminated on both sides thereof with polyethylene film and, after subjected to a corona discharge treatment on the surface, provided a gelatin prime coated layer containing sodium dodecylbenzenesulfonate. Coating solutions were prepared as follows:

Preparation of the first layer coating solution 19.1 Grams of yellow coupler (ExY), 4.4 g of image-dye stabilizer (Cpd-1), and 2.3 g of image-dye stabilizer (Cpd-7) were added and dissolved to a mixture of 27.2 ml of ethyl acetate and 8.2 g of solvent (Solv-1). The resulting solution was dispersed and emulsified in 185 ml of 10% aqueous gelatin solution containing 8 ml of 10% sodium dodecylbenzenesulfonate solution, thereby prepared emulsified dispersion A. Separately silver chlorobromide emulsion A (cubic grains, 3:7 (silver molar ratio) blend of large size grain emulsion A and small size grain emulsion A having 0.88 μm and 0.70 μm of average grain size, the deviation coefficient of which grain size being 0.08 and 0.10, respectively, and each in which 0.3 mol % of silver bromide was located at the surface of grains and the remainder was silver chloride) was prepared. Blue-sensitive sensitizing dyes A and B, shown below, were added in this emulsion in such amount of $2.0\times10^{-4}$ mol to the large size emulsion A and $2.5\times10^{-4}$ tool to the small size emulsion B, per mol of silver, respectively. The chemical ripening was carried out by adding sulfur and gold sensitizing agents. The above-described emulsified dispersion and this emulsion were mixed together and dissolved to give the composition shown below, thereby preparing the first: layer coating solution. Coating solutions for the second to the seventh layer were also prepared in the same manner as the first layer coating solution. As a gelatin hardener for the respective layers, 1-hydroxy-3,5-dichloro-s-triazine sodium salt was used.

As spectral-sensitizing dyes for the respective layers, the following compounds were used:

Sensitizing dye A for blue-sensitive emulsion layer

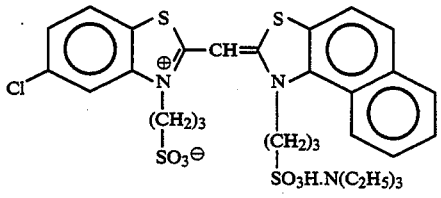

Sensitizing dye B for blue-sensitive emulsion layer

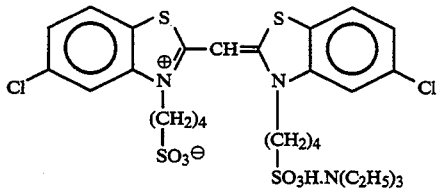

(each $2.0\times10^{-4}$ mol to the large size emulsion and $2.5\times10^{-4}$ mol to the small size emulsion, per mol of silver halide.)

Sensitizing dye C for green-sensitive emulsion layer

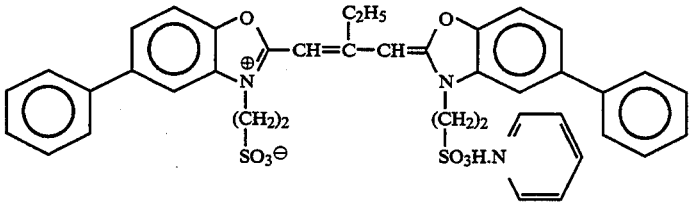

($4.0\times10^{-4}$ mol to the large size emulsion and $5.6\times10^{-4}$ mol to the small size emulsion, per mol of silver halide)

Sensitizing dye D for green-sensitive emulsion layer

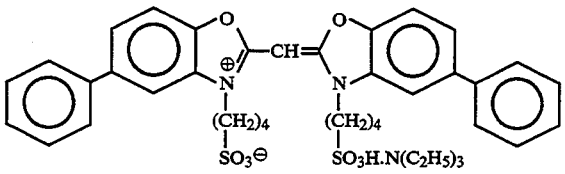

($7.0\times10^{-5}$ mol to the large size emulsion and $1.0\times10^{-5}$ mol to the small size emulsion, per mol of silver halide)

Sensitizing dye E for red-sensitive emulsion layer

-continued

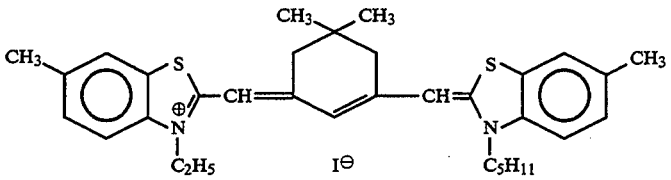

($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

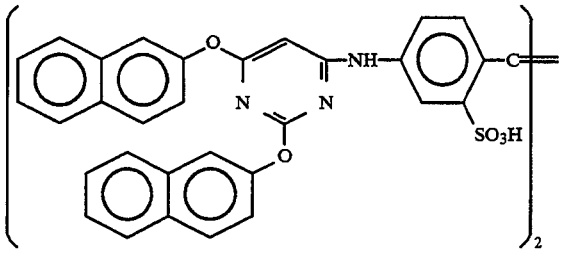

Further, 1-(5-methylureidophenyl )-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

Further, 4-hydroxy-6-methyl-1,3,3a, 7-tetrazaindene was added to the blue-sensitive emulsion layer and the red-sensitive emulsion layer in amount of $1\times10^{-4}$ tool and $2\times10^{-4}$ mol, per mol of silver halide, respectively.

The dyes shown below (figure in parentheses represents coating amount) were added to the emulsion layers for prevention of irradiation.

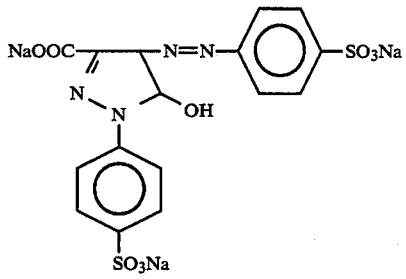

(10 mg/m²)

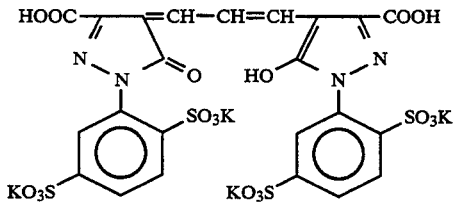

(10 mg/m²)

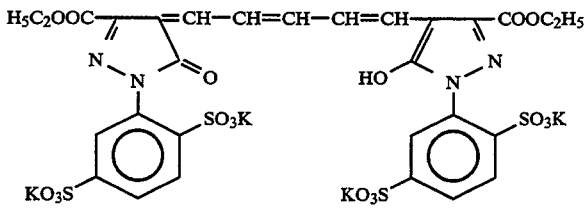

(40 mg/m²)

and

-continued

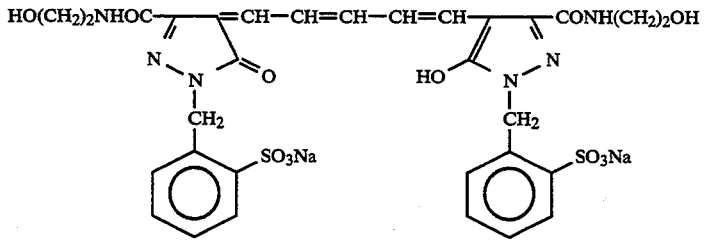

(20 mg/m$^2$)

(Composition of Layers )

The composition of each layer is shown below. The figures represent coating amount (g/m2). The coating amount of each silver halide emulsion is given in terms silver.

| | |
|---|---|
| Supporting Base | |
| Paper laminated on both sides with polyethylene [a white pigment ($TiO_2$) and a bluish dye (ultramarine) were included in the first layer side of the polyethylene-laminated film] | |
| First Layer (Blue-sensitive emulsion layer) | |
| The above-described silver chlorobromide emulsion A | 0.30 |
| Gelatin | 1.56 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.10 |
| Second Layer (Color-mix preventing layer) | |
| Gelatin | 0.64 |
| Color-mix inhibitor (Cpd-5) | 0.10 |
| Solvent (Solv-1) | 0.16 |
| Solvent (Solv-4) | 0.08 |
| Third Layer (Green-sensitive emulsion layer) | |
| Silver chlorobromide emulsions (cubic grains, 1:3 (Ag mol ratio) blend of large size emulsion having average grain size of 0.55 μm and small size emulsion having average grain size of 0.39 μm, each of whose deviation coefficient of grain size distribution is 0.10 and 0.08, respectively, each in which 0.8 mol % of AgBr was located at the surface of grains and the remainder was silver chloride.) | 0.12 |
| Gelatin | 1.20 |
| Magenta coupler (ExM) | 0.23 |
| Image-dye stabilizer (Cpd-2) | 0.03 |
| Image-dye stabilizer (Cpd-3) | 0.16 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet rays-absorbing layer) | |
| Gelatin | 1.41 |
| Ultraviolet-absorber (UV-1) | 0.47 |
| Color-mix inhibitor (Cpd-5) | 0.05 |
| Solvent (Solv-5) | 0.24 |
| Fifth Layer (Red-sensitive emulsion layer) | |
| Silver chlorobromide emulsions (cubic grains, 1:4 (Ag mol ratio) blend of large size emulsion having average grain size of 0.58 μm and small size emulsion having average grain size of 0.45 μm, each of whose deviation coefficient of grain size distribution is 0.09 and 0.11, respectively, each in which 0.6 mol % of AgBr was located at the surface of grains and the remainder was silver chloride.) | 0.23 |
| Gelatin | 1.04 |
| Cyan coupler (ExC) | 0.32 |
| Image-dye stabilizer (Cpd-2) | 0.03 |
| Image-dye stabilizer (Cpd-4) | 0.02 |
| Image-dye stabilizer (Cpd-6) | 0.18 |
| Image-dye stabilizer (Cpd-7) | 0.40 |
| Image-dye stabilizer (Cpd-8) | 0.05 |
| Solvent (Solv-6) | 0.14 |
| Sixth layer (Ultraviolet rays-absorbing layer) | |
| Gelatin | 0.48 |
| Ultraviolet absorber (UV-1) | 0.16 |
| Color-mix inhibitor (Cpd-5) | 0.02 |
| Solvent (Solv-5) | 0.08 |
| Seventh layer (Protective layer) | |
| Gelatin | 1.10 |
| Acryl-modified copolymer of polyvinyl alcohol (modification degree 17%) | 0.17 |
| Liquid paraffin | 0.03 |

Compounds used are as follows:
(ExY) Yellow coupler

-continued
Mixture (1:1 in molar ratio) of
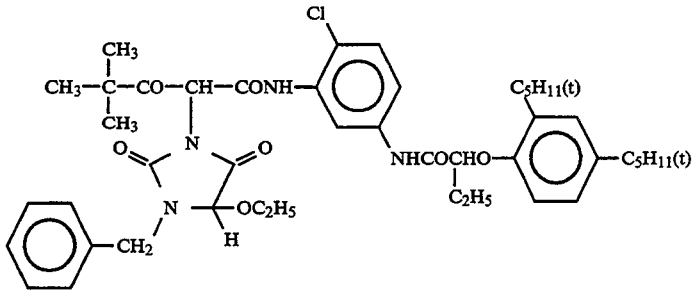
and
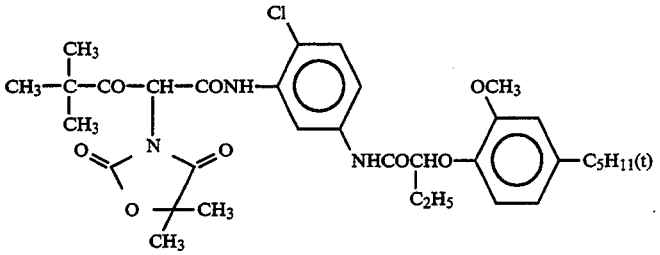
(ExM) Magenta coupler
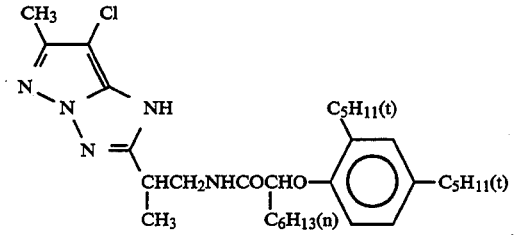
(ExC) Cyan coupler
Mixture (1:1 in molar ratio) of
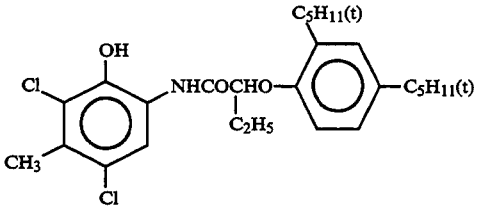
and
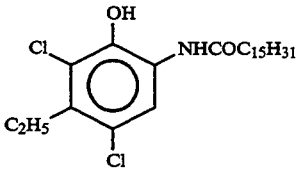
(Cpd-1) Image-dye stabilizer
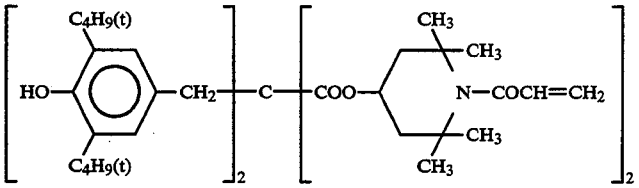

-continued
(Cpd-2) Image-dye stabilizer
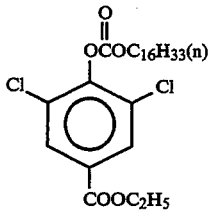
(Cpd-3) Image-dye stabilizer
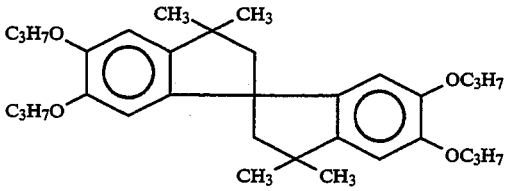
(Cpd-4) Image-dye stabilizer
Mixture (1:1 in molar ratio) of
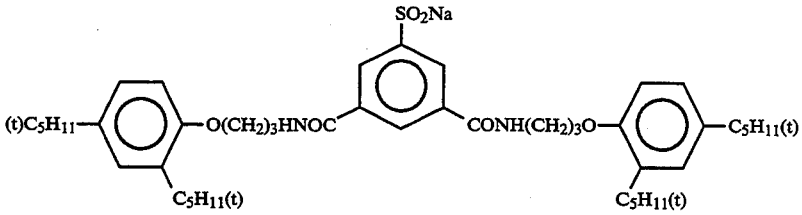
and
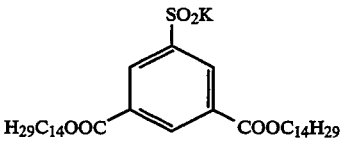
(Cpd-5) Color-mix inhibitor
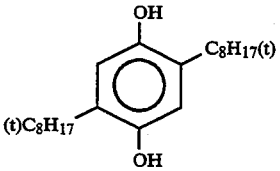
(Cpd-6) Image-dye stabilizer
Mixture (2:4:4 in weight ratio) of
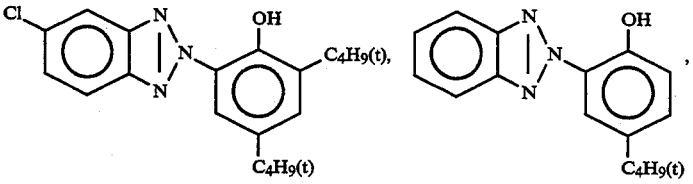
and
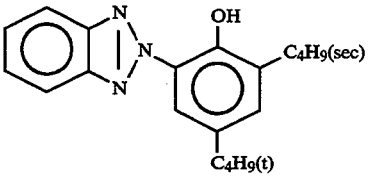

-continued
(Cpd-7) Image-dye stabilizer
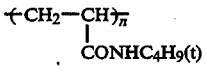
Average molecular weight: 60,000
(Cpd-8) Image-dye stabilizer
Mixture (1:1 in weight ratio) of
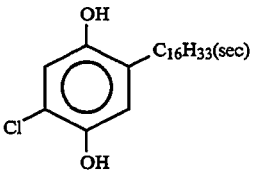
and
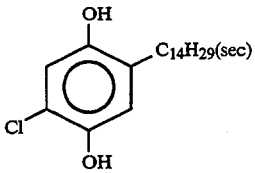
(Cpd-9) Image-dye stabilizer
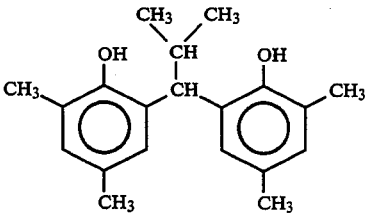
(Cpd-10) Antiseptic
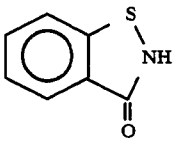
(Cpd-11) Antiseptic
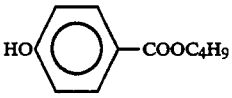
(UV-1) Ultraviolet ray absorber
Mixture (4:2:4 in weight ratio) of
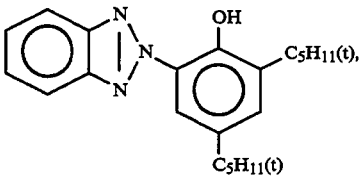
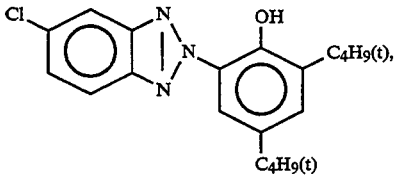
and
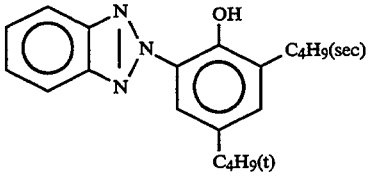
(Solv-1) Solvent
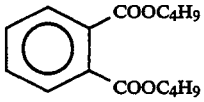

-continued (Solv-2) Solvent
Mixture (1:1 in volume ratio) of

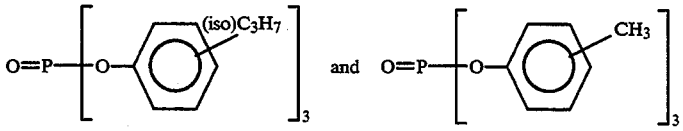

(Solv-4) Solvent

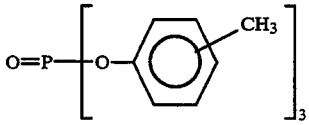

(Solv-5) Solvent

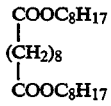

(Solv-6) Solvent
Mixture (80:20 in volume ratio) of

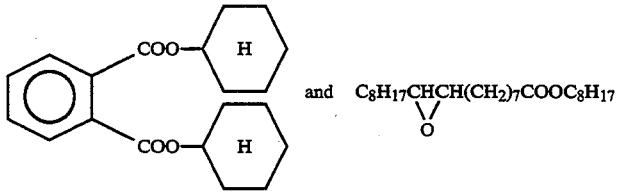

Samples 102 to .111 were prepared in the same manner as Sample 123, except that the yellow coupler (ExY) and solvent (Solv-1) in the blue-sensitive emulsion layer were changed, respectively, as shown in Table 1. Each yellow coupler was replaced in equimolor amount and each solvent was replaced in the same weight, as those in Sample 1.

Thus prepared Samples were designated as A group (A-101 to A-111). Samples of A group are those coated a coupler emulsified dispersion immediately after preparation.

Samples were prepared in the same manner as Samples of A group, except that each emulsified dispersion was kept to stand at room temperature for one week and then coated after being made up as coating solution in the same manner as those of Samples of A group, which were designated as B group (B-101 to B-111).

Each of Samples prepared as described above was subjected to a gradation exposure to light through three colors separation filter for sensitometry using a sensitometer (FWH model made by Fuji Photo Film Co., Ltd., the color temperature of light source was 3200 K). At that time, the exposure was carried out in such a manner that the exposure amount was 250 CMS with the exposure time being 0.1 sec.

After exposure to light, each sample was subjected to a continuous processing (running test), until the replenishing amount of color developer reached to two times tank volume, by the following processing process and processing solutions using a paper processor.

| Processing step | Temperature | Time | Replenisher* | Tank Volume |
|---|---|---|---|---|
| Color developing | 35° C. | 45 sec | 161 ml | 17 liter |
| Bleach-fixing | 30–35° C. | 45 sec | 215 ml | 17 liter |
| Rinse 1 | 30–35° C. | 20 sec | — | 10 liter |
| Rinse 2 | 30–35° C. | 20 sec | — | 10 liter |
| Rinse 3 | 30–35° C. | 20 sec | 350 ml | 10 liter |
| Drying | 70–80° C. | 60 sec | | |

Note:
*Replenisher amount per $m^2$ of photographic material.

Rinsing steps were carried out in 3-tanks countercurrent mode from the tank of rinse 3 toward the tank of rinse 1.

The composition of each processing solution is as follows, respectively:

| Color-developer | Tank Solution | Replenisher |
|---|---|---|
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-Bis(carboxymethyl)hydrazine | 4.0 g | 5.0 g |
| Monosodium N,N-di(sulfoethyl)-hydroxylamine | 4.0 g | 5.0 g |
| Fluorescent whitening agent (WHITEX-4B, made by Sumitomo Chemical Ind.) | 1.0 g | 2.0 g |

-continued

| | | |
|---|---|---|
| Water to make | 1000 ml | 1000 ml |
| pH (25° C.) | 10.05 | 10.45 |

| Bleach-fixing solution (Both tank solution and replenisher) | |
|---|---|
| Water | 400 ml |
| Ammonium thiosulfate (70 g/l) | 100 ml |
| Sodium sulfite | 17 g |
| Iron (III) ammonium ethylenediamine-tetraacetate dihydrate | 55 g |
| Disodium ethylenediaminetetraacetate | 5 g |
| Ammonium bromide | 40 g |
| Water to make | 1000 ml |
| pH (25° C.) | 6.0 |

| Rinse solution (Both tank solution and replenisher) |
|---|
| Ion-exchanged water (calcium and magnesium each are 3 ppm or below) |

With respect to processed Samples (A group and B group) thus obtained, the maximum yellow color density (Dmax) was determined, and the stability of each emulsified dispersion for Samples was obtained as a percentage by the following calculation:

$$\text{Stability of emulsified dispersion} = \frac{\text{Dmax of each Sample of B group}}{\text{Dmax of each Sample of A group}} \times 100$$

Results are shown in Table 1.

TABLE 1

| Sample No. | First layer: Yellow coupler | First layer: Solvent | Stability of emulsified dispersion* | Remarks |
|---|---|---|---|---|
| 101 | ExY | Solv-1 | 100 | Comparison |
| 102 | " | E-1 | 100 | " |
| 103 | Y-3 | Solv-1 | 60 | " |
| 104 | " | Solv-4 | 55 | " |
| 105 | " | E-1 | 100 | This invention |
| 106 | " | E-4 | 99 | " |
| 107 | " | E-6 | 99 | " |
| 108 | Y-5 | E-21 | 100 | " |
| 109 | Y-6 | E-18 | 100 | " |
| 110 | Y-18 | E-1 | 101 | " |
| 111 | Y-22 | " | 100 | " |

Note:
*Percentage of yellow Dmax of Sample of B group to yellow Dmax of Sample of A group As is apparent from the results in Table 1, when the present coupler and the present compound represented by formula (II) are used, a photographic material improved in the stability of emulsified dispersion of the present yellow coupler can be provided. This is unexpected because the effect of stability improvement of emulsion had not been attained when a conventional yellow coupler were used in combination with the compound represented by formula (II).

EXAMPLE 2

Emulsified dispersions 201 to 211 for the first layer were prepared in the same manner as the emulsion for Sample 101 in Example 1, except that the coupler and solvent were replaced with those shown in Table 2. The thus-prepared emulsified emulsions each were coated immediately, in the same manner as Sample 101, thereby preparing Samples of A group (A-201 to A-211). Separately, each of emulsified dispersions 201 to 211 was allowed to stand for a week at room temperature, and then was coated in the same manner as the above, thereby preparing Samples of B group (B-201 to B-211), respectively.

Each Sample of A group and B group was subjected to the same color development processing as Example 1 and then the maximum yellow color density (Dmax) of each processed Sample was determined, and the stability of each emulsified dispersion for Samples was obtained in the same manner as Example 1.

Results are shown in Table 2.

Further, each Sample of A group was subjected to a fading test under a condition of 60° C. and 70% RH. Results are shown in Table 2.

TABLE 2

| Sample No. | Yellow coupler in the 1st layer | Solvent in the 1st layer* | Stability of emulsified dispersion** | Residual rate of dye after fading test (60° C., 70% RH, 3 months) (%) | Remarks |
|---|---|---|---|---|---|
| 201 | ExY | Solv-1 | 100 | 77 | Comparison |
| 202 | " | Solv-1 + E-1 (1:1) | 100 | 78 | " |
| 203 | Y-3 | Solv-1 | 58 | 95 | " |
| 204 | " | Solv-4 | 52 | 96 | " |
| 205 | " | Solv-1 + E-1 (1:1) | 100 | 96 | This invention |
| 206 | " | Solv-4 + E-1 (1:1) | 99 | 95 | " |
| 207 | " | A-15 + E-1 (1:1) | 100 | 98 | " |
| 208 | Y-5 | A-15 + E-4 (1:1) | 100 | 97 | " |
| 209 | Y-6 | A-15 + E-6 (1:1) | 101 | 97 | " |
| 210 | Y-18 | A-15 + E-21 (1:1) | 101 | 95 | " |
| 211 | Y-22 | A-19 + E-18 (1:1) | 100 | 96 | " |

Note:
*Replaced so as to be the total weight equal to that of solvent of Sample 201 (Solv-1).
**A percentage of Dmax of yellow of Sample of B group to that of sample of A Group.

As is apparent from the results in Table photographic material Samples 205 to 211 prepared by using the present coupler and the compound represented by formula (II) or (III ) of the present invention are excellent in the stability of emulsified dispersion and the heat-fastness of a yellow image formed.

EXAMPLE 3

When the processed Samples of A group were subjected to a fading test by the irradiation of Xenon light source of 76,900 lux for five days, it was found that Samples using compound represented by formula (II) or (III) of the present invention (Samples 207 to 211) are excellent particularly in light fastness. Results are shown in Table 3.

TABLE 3

| Sample No. | Residual rate of dye after fading test (Xenon, 5 days) (%) |
|---|---|
| 201 | 74 |
| 202 | 73 |
| 203 | 49 |

TABLE 3-continued

| Sample No. | Residual rate of dye after fading test (Xenon, 5 days) (%) |
|---|---|
| 204 | 49 |
| 205 | 50 |
| 206 | 48 |
| 207 | 77 |
| 208 | 78 |
| 209 | 77 |
| 210 | 79 |
| 211 | 78 |

Thus, a photographic material excellent in all of the stability of the emulsified dispersion, wet-and-heat fastness, and light fastness can be obtained by a combined use of the yellow coupler represented by formula (I-1) or (I-2) and the compound represented by formula (II) or (III).

EXAMPLE 4

A multilayer color print paper (Sample 300 ) having layer compositions shown below was prepared on a paper support laminated on both sides thereof with polyethylene film and, after subjected to a corona discharge treatment on the surface, provided a gelatin prime coated layer containing sodium dodecylbenzenesulfonate. Coating solutions were prepared as follows:

Preparation of the first layer coating solution 132.0 Grams of yellow coupler (ExY), 15.0 g of image-dye stabilizer (Cpd-1), and 7.5 g of image-dye stabilizer (Cpd-2) were added and dissolved to a mixture of 25 g of solvent (Solv-2) and 180 ml of ethyl acetate. The resulting solution was dispersed and emulsified 1,000 g of 10% aqueous gelatin solution containing 60 ml of 10% sodium dodecylbenzenesulfonate solution and 10 g of citric acid, thereby prepared emulsified dispersion A.

This emulsified dispersion A and the silver chlorobromide emulsion A of Example 1 were mixed together and dissolved to give the composition shown below, thereby preparing the first layer coating solution. The coating amount of emulsion is shown as a coating amount in terms of silver.

Coating solutions for the second to the seventh layer were also prepared in the same manner as the first layer coating solution. As a gelatin hardener for the respective layers, 1-hydroxy-3,5-dichloro-s-triazine sodium salt was used.

In each layer, Cpd-14 and Cpd-15 were added in such amounts that the total amount in the respective layers is 25.0 mg/m$^2$ and 50 mg/m$^2$, respectively.

The following spectral sensitizing dyes were used in each photosensitive layer other than blue-sensitive emulsion layer.

Green-sensitive emulsion layer:

Sensitizing dye C

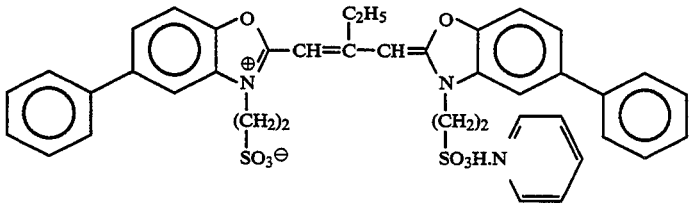

($4.0\times10^{-4}$ mol to the large size emulsion and $5.6\times10^{-4}$ mol to the small size emulsion, per mol of silver halide )

Sensitizing dye D

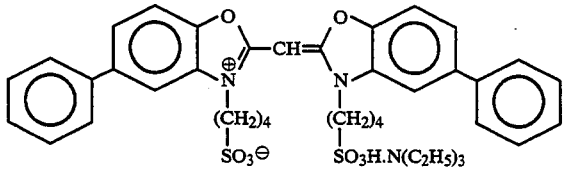

($7.0\times10^{-5}$ mol to the large size emulsion and $1.0\times10^{-5}$ mol to the small size emulsion, per mol of silver halide )

Red-sensitive emulsion layer:

Sensitizing dye E

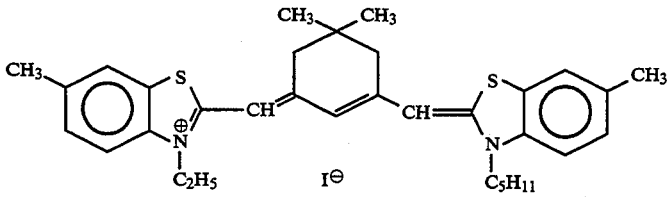

($0.9\times10^{-4}$ mol to the large size emulsion and $1.1\times10^{-4}$ mol to the small size emulsion, per mol of silver halide To the red-sensitive emulsion layer, the following compound was added in an amount of $2.6\times10^{-3}$ mol per mol of silver halide:

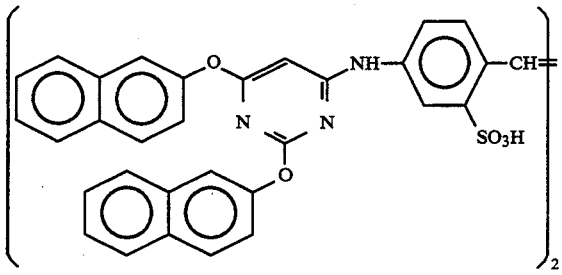

Further, 1-(5-methyhreidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

Further, 4-hydroxy-6-methyl-1,3,3a, 7-tetrazaindene was added to the blue-sensitive emulsion layer and the green-sensitive emulsion layer in amount of $1\times10^{-4}$ mol and $2\times10^{-4}$ mol, per mol of silver halide, respectively.

The dyes shown below (figure in parentheses represents coating amount) were added to the emulsion layers for prevention of irradiation.

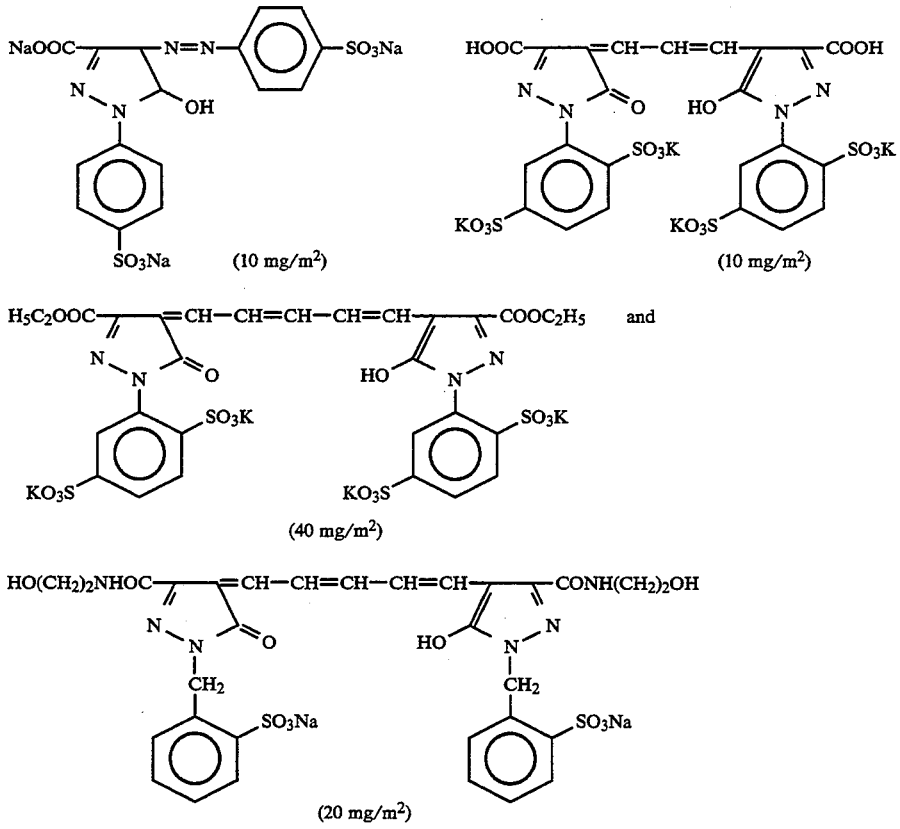

(Composition of Layers)

The composition of each layer is shown below. The figures represent coating amount (g/m²). The coating amount of each silver halide emulsion is given in terms of silver.

| | |
|---|---|
| Supporting Base | |
| Paper laminated on both sides with polyethylene [a white pigment ($TiO_2$) and a bluish dye (ultramarine) were included in the first layer side of the polyethylene-laminated film] | |
| First Layer (Blue-sensitive emulsion layer) | |
| The above-described silver chlorobromide emulsion A | 0.27 |
| Gelatin | 1.36 |
| Yellow coupler (ExY) | 0.75 |
| Image-dye stabilizer (Cpd-1) | 0.15 |
| Image-dye stabilizer (Cpd-2) | 0.06 |
| Solvent (Solv-2) | 0.30 |
| Second Layer (Color-mix preventing layer) | |
| Gelatin | 1.00 |
| Color-mix inhibitor (Cpd-4) | 0.08 |
| Solvent (Solv-7) | 0.03 |
| Solvent (Solv-2) | 0.25 |
| Solvent (Solv-3) | 0.25 |
| Third Layer (Green-sensitive emulsion layer) | |
| Silver chlorobromide emulsions (cubic grains, 1:3 (Ag mol ratio) blend of large size emulsion having average grain size of 0.55 μm and small size emulsion having average grain size of 0.39 μm, each of whose deviation coefficient of grain size distribution is 0.10 and 0.08, respectively, each in which 0.8 mol % of AgBr was located at the surface of grains and the remainder was silver chloride.) | 0.13 |
| Gelatin | 1.45 |
| Magenta coupler (ExM) | 0.16 |
| Image-dye stabilizer (Cpd-5) | 0.15 |

-continued

| | |
|---|---|
| Image-dye stabilizer (Cpd-2) | 0.03 |
| Image-dye stabilizer (Cpd-6) | 0.01 |
| Image-dye stabilizer (Cpd-7) | 0.01 |
| Image-dye stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (Color-mix preventing layer) | |
| Gelatin | 0.70 |
| Color-mix inhibitor (Cpd-4) | 0.05 |
| Solvent (Solv-7) | 0.02 |
| Solvent (Solv-2) | 0.18 |
| Solvent (Solv-3) | 0.18 |
| Fifth Layer (Red-sensitive emulsion layer) | |
| Silver chlorobromide emulsions (cubic grains, 1:4 (Ag mol ratio) blend of large size emulsion having average grain size of 0.50 gm and small size emulsion having average grain size of 0.41 μm, each of whose deviation coefficient of grain size distribution is 0.09 and 0.11, respectively, each in which 0.8 mol % of AgBr was located at the surface of grains and the remainder was silver chloride.) | 0.20 |
| Gelatin | 0.85 |
| Cyan coupler (ExC) | 0.33 |
| Ultraviolet-absorber (UV-2) | 0.18 |
| Image-dye stabilizer (Cpd-9) | 0.01 |
| Image-dye stabilizer (Cpd-10) | 0.01 |
| Image-dye stabilizer (Cpd-11) | 0.01 |
| Solvent (Solv-6) | 0.22 |
| Image-dye stabilizer (Cpd-8) | 0.01 |
| Image-dye stabilizer (Cpd-6) | 0.01 |
| Solvent (Solv-1) | 0.01 |
| Image-dye stabilizer (Cpd-1) | 0.33 |
| Sixth layer (Ultraviolet rays-absorbing layer) | |
| Gelatin | 0.55 |
| Ultraviolet absorber (UV-1) | 0.38 |
| Image-dye stabilizer (Cpd-12) | 0.15 |
| Image-dye stabilizer (Cpd-5) | 0.02 |
| Seventh layer (Protective layer) | |
| Gelatin | 1.13 |
| Acryl-modified copolymer of polyvinyl alcohol (modification degree: 17%) | 0.05 |
| Liquid paraffin | 0.02 |
| Image-dye stabilizer (Cpd-13) | 0.01 |

Compounds used are as follows:
(ExY) Yellow coupler
The same as (ExY) in Example 1
(ExM) Magenta coupler
The same as (ExM) in Example 1
(ExC) Cyan coupler
Mixture (3:7 in molar ratio) of

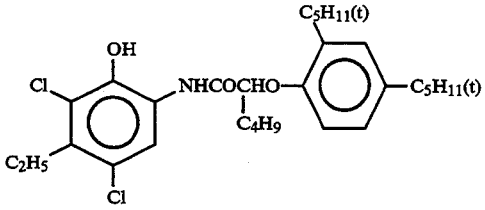

and

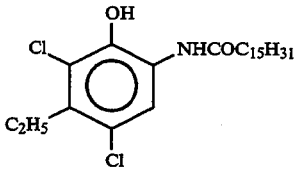

(Cpd-1) Image-dye stabilizer

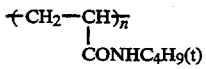

(Cpd-2) Image-dye stabilizer

-continued
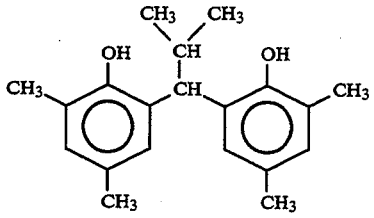
(Cpd-3) Image-dye stabilizer
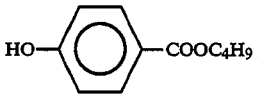
n = 7~8 (average)
(Cpd-4) Color-mix inhibitor
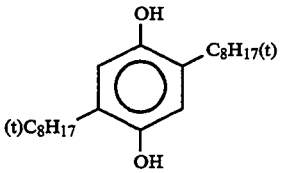
(Cpd-5) Image-dye stabilizer
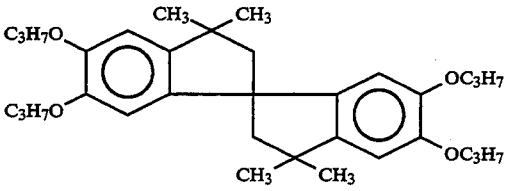
(Cpd-6) Image-dye stabilizer
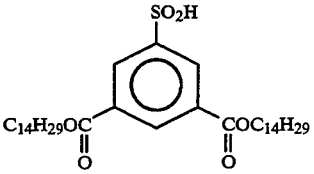
(Cpd-7) Image-dye stabilizer
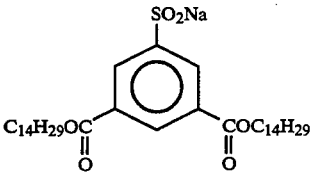
(Cpd-8) Image-dye stabilizer
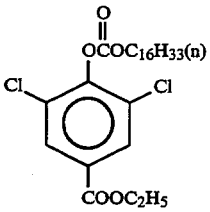
(Cpd-9) Image-dye stabilizer -continued
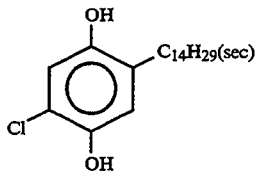
(Cpd-10) Image-dye stabilizer
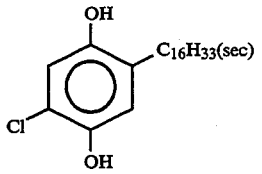
(Cpd-11) Image-dye stabilizer
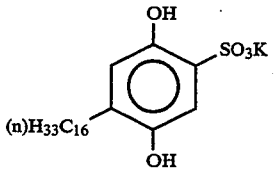
(Cpd-12) Image-dye stabilizer
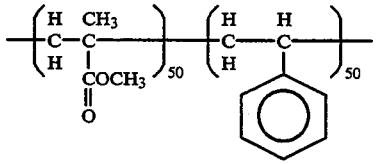
av. molecular weight 60,000
(Cpd-13) Image-dye stabilizer
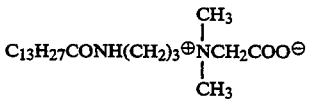
(Cpd-14) Antiseptic
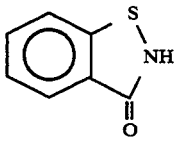
(Cpd-15) Antiseptic
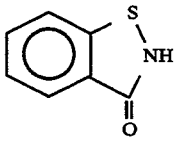
(UV-1) Ultraviolet absorber
Mixture of (1), (2), (3), and (4)
of 1:5:10:5 in weight ratio.

-continued
(1) 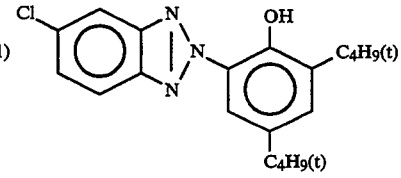
(2) 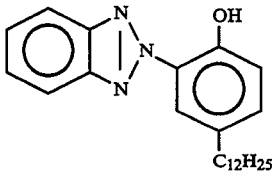
(3) 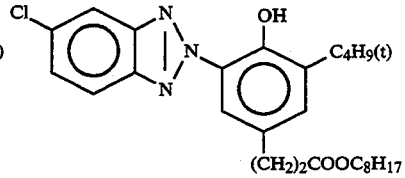
(4) 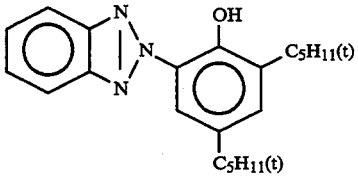
(UV-2) Ultraviolet absorber
Mixture of (1), (2), and (3)
of 1:2:2 in weight ratio,
(1) 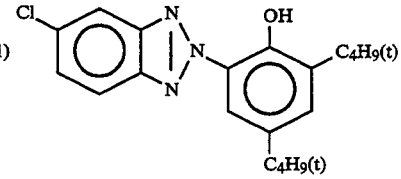
(2) 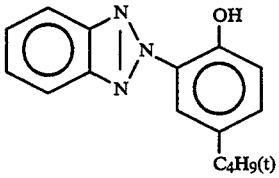
(3) 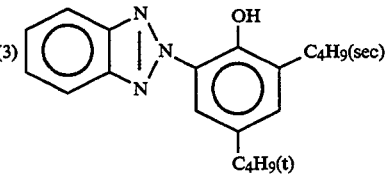
(Solv-1) Solvent
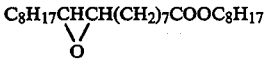
(Solv-2) Solvent
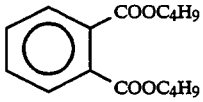
(Solv-3) Solvent
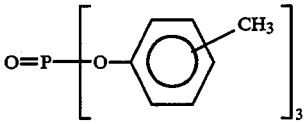
(Solv-4) Solvent
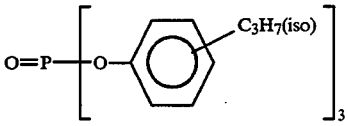
(Solv-5) Solvent
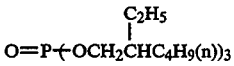
(Solv-6) Solvent -continued

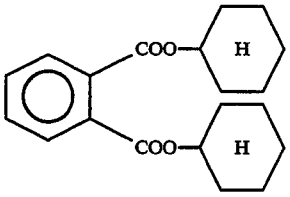

(Solv-7) Solvent

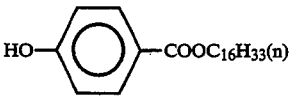

Samples 301 to 346 were prepared in the same manner as Sample 300, except that yellow coupler (ExY) and solvent (Solv-2) in the blue-sensitive emulsion layer of Sample 300 were replaced with couplers and solvents shown in Tables 4 and 5, respectively, and an amide compound was further added in some cases as shown in Table 5. Each yellow coupler was used in an equimolar amount with that of Sample 300, and each solvent was used in an equal weight with that of Sample 300. Further, the coating amount of coating solution liquid was reduced to 70% of Sample 300 so as to give a nearly equal color density in each Sample.

With respect to Samples 300 to 346, A and B groups were prepared in the same manner as Example 1, and they were subjected to a processing in the same manner as Examples 2 and 3 for evaluation of color-forming property and fading property of processed Samples. The fading property was evaluated after storage for 20 days under a condition of 80° C. and 70% RH, and after intermittent irradiation of light for 10 days using a xenon lamp of 100,000 lux.

Results are shown in Table 4 and 5.

TABLE 4

| Sample No. | Yellow coupler | Solvent* | Stability of emulsion | Remarks |
|---|---|---|---|---|
| 300 | ExY | Solv-2 | 100 | Comparison |
| 301 | " | Solv-5 | 99 | " |

TABLE 4-continued

| Sample No. | Yellow coupler | Solvent* | Stability of emulsion | Remarks |
|---|---|---|---|---|
| 302 | " | E-1 | 100 | " |
| 303 | " | Solv-2/E-1(1/1) | 96 | " |
| 304 | " | Solv-2/E-21(1/1) | 94 | " |
| 305 | Y-67 | Solv-2 | 75 | " |
| 306 | " | Solv-5 | 68 | " |
| 307 | " | E-1 | 99 | This invention |
| 308 | " | Solv-2/E-1(1/1) | 100 | " |
| 309 | " | Solv-2/E-21(1/1) | 99 | " |
| 310 | " | E-1/E-21(1/1) | 100 | " |
| 311 | " | Solv-5/E-21(2/1) | 99 | " |
| 312 | Y-72 | Solv-2 | 63 | Comparison |
| 313 | " | Solv-5 | 57 | " |
| 314 | " | E-1 | 98 | This invention |
| 315 | " | Solv-2/E-21(1/1) | 99 | " |
| 316 | " | Solv-5/E-21(2/1) | 100 | " |
| 317 | " | Solv-5/E-5(2/1) | 99 | " |
| 318 | " | Solv-5/E-16(2/1) | 97 | " |
| 319 | Y-73 | Solv-2 | 42 | Comparison |
| 320 | " | Solv-5 | 37 | " |
| 321 | " | E-1 | 93 | This invention |
| 322 | " | Solv-2/E-21(1/1) | 97 | " |
| 323 | " | Solv-5/E-21(2/1) | 96 | " |
| 324 | Y-75 | Solv-2 | 54 | Comparison |
| 325 | " | Solv-5 | 50 | " |
| 326 | " | E-1 | 94 | This invention |
| 327 | " | Solv-2/E-21(1/1) | 99 | " |
| 328 | " | Solv-5/E-21(2/1) | 97 | " |

Note:
*Figure in parentheses is a ratio in weight.

TABLE 5

| Sample No. | Yellow coupler | Solvent* (epoxy compound) | Amide Compound | Stability** of emulsion | Wet-and-heat fading (20 days at 80° C., 70% RH) | Light-fading (10 days (under Xe lamp) | Remarks |
|---|---|---|---|---|---|---|---|
| 329 | ExY | Solv-2 | — | 100 | 65% | 72% | Comparison |
| 330 | " | Solv-5 | — | 99 | 67% | 75% | " |
| 331 | " | Solv-5/E-21(2/1) | — | 95 | 76% | 77% | " |
| 332 | " | Solv-5/E-21(2/1) | A-15 | 91 | 75% | 79% | " |
| 333 | " | Solv-5/E-21(2/1) | A-4 | 92 | 75% | 78% | " |
| 334 | Y-72 | Solv-2 | — | 63 | 89% | 48% | Comparison |
| 335 | " | Solv-5 | — | 57 | 92% | 59% | " |
| 336 | " | Solv-5/E-21(2/1) | — | 100 | 95% | 78% | This invention |
| 337 | " | Solv-5/E-21(2/1) | A-15 | 100 | 96% | 90% | " |
| 338 | " | Solv-5/E-21(2/1) | A-4 | 99 | 96% | 87% | " |
| 339 | " | E-1 | — | 98 | 94% | 66% | " |
| 340 | " | E-1 | A-15 | 99 | 97% | 81% | " |
| 341 | Y-67 | Solv-5 | — | 68 | 91% | 52% | Comparison |
| 342 | " | Solv-5/E-21(2/1) | — | 99 | 95% | 63% | This invention |
| 343 | " | Solv-5/E-21(2/1) | A-15 | 100 | 95% | 86% | " |
| 344 | Y-70 | Solv-5 | — | 51 | 90% | 49% | Comparison |
| 345 | " | Solv-5/E-21(2/1) | — | 97 | 94% | 60% | This invention |

TABLE 5-continued

| Sample No. | Yellow coupler | Solvent* (epoxy compound) | Amide Compound | Stability** of emulsion | Wet-and-heat fading (20 days at 80° C., 70% RH) | Light-fading (10 days (under Xe lamp) | Remarks |
|---|---|---|---|---|---|---|---|
| 346 | " | Solv-5/E-21(2/1) | A-15 | 99 | 95% | 83% | " |

Note:
*Replaced so as to be the total weight equal to that of solvent of Sample 201 (Solv-1).
**A percentage of Dmax of yellow of Sample of group B to that of sample of Group A.

As is apparent from the results in Tables 4 and 5, in the photographic materials of the present invention, the stability of emulsion comprising the present coupler is remarkably improved by dispersing the coupler in solvent using the present epoxy compound, and the light-fading property of the photographic material can be improved by combined use of amide compound.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic material having at least one cyan color-forming silver halide emulsion layer, at least one magenta color-forming silver halide emulsion layer, and at least one yellow color-forming silver halide emulsion layer, on a support, which comprises, in said yellow color-forming silver halide emulsion layer, at least one nondiffusible yellow coupler,- represented by the following formula (I-1) or (I-2) and an organic compound represented by the following formula (II):

formula (I-1)

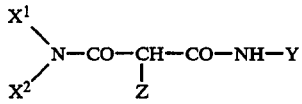

formula (I-2)

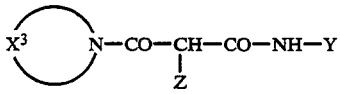

wherein $X^1$ and $X^2$ each represent an alkyl group, an aryl group, or a heterocyclic group, X3 represents an organic residue to form a nitrogen-containing heterocyclic group together with the >N—, Y represents an aryl group or a heterocyclic group, and Z is a non-photographically useful coupling releasing group capable of being released upon a coupling reaction of the coupler represented by formula (I-1) or (I-2) with the oxidized product of a color developing agent, and formula (II)

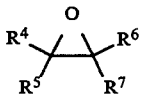

wherein $R^4$, $R^5$, $R^6$, and $R^7$ each represent a hydrogen atom, an aliphatic group, an aromatic group, an aliphatic-oxycarbonyl group, an aromatic-oxycarbonyl group, or a carbamoyl group, provided that each of $R^4$, $R^5$, $R^6$, and $R^7$ does not represent a hydrogen atom at the same time.

2. The silver halide color photographic material as claimed in claim 1, wherein an organic compound represented by the following formula (III) is further contained in the said yellow color-forming silver halide layer:

formula (III)

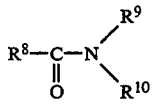

wherein $R^8$ $R^9$ and $R^{10}$ each represent an alkyl group or an aryl group, and when $R^9$ and $R^{10}$ each represent an alkyl group, the alkyl groups may bond together to form a 5- to 7-membered ring.

3. The silver halide color photographic material as claimed in claim 1, wherein the yellow coupler represented by formula (I-1) or (I-2) is selected from the group consisting of compounds represented by the following formula (I-3), (I-4), and (I-5):

formula (I-3)

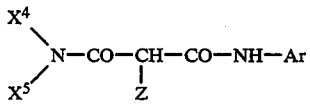

formula (I-4)

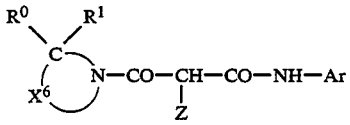

formula (I-5)

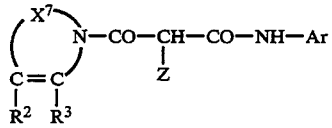

wherein Z has the same meaning as defined in formula (I-1), $X^4$ represents an alkyl group, $X^5$ represents an alkyl group or an aromatic group, Ar represents a phenyl group having at least one substituent in the ortho position, $X^6$ represents an organic residue to form a nitrogen-containing cyclic group (monocyclic or condensed ring) together with the —C(ROR¹)—N<, $X^7$ represents an organic residue required to form a nitrogen heterocyclic group (monocyclic or condensed ring) together with the —C(R²)=C(R³)—N<, and $R^0$, $R^1$, $R^2$, and $R^3$ each represent a hydrogen atom or a substituent.

4. The silver halide color photographic material as claimed in claim 1, wherein $X^1$ or $X^2$ in formula (I-1) is an alkyl group having 1 to 10 carbon atoms.

5. The silver halide color photographic material as claimed in claim 1, wherein Y in formulas (I- and (I-2) is a phenyl group having at least one substituent on the ortho position thereof.

6. The silver halide color photographic material as claimed in claim 1, wherein Z in formulas (I- and (I-2) is a 5- to 6-membered nitrogen-containing heterocyclic group bonded to the coupling site through the nitrogen atom, an aromatic-oxy group, a 5- to 6-membered heterocyclic-oxy group, or a 5- to 6-membered heterocyclic-thio group.

7. The silver halide color photographic material as claimed in claim 2, wherein $R^8$, $R^9$, and $R^{10}$ in formula (III) each represented an alkyl group or an aryl group substituted by a halogen atom, an alkyl group, an alkoxy group, an aryl group, an aryloxy group, an alkylsulfonyl group, an aryl group, an aryloxy group, an alkylsulfonyl group, an arylsulfonyl group, an alkoxycarbonyl group, or a carbamoyl group.

8. The silver halide color photographic material as claimed in claim 2, wherein the organic compound represented by formula (III) is represented by the following formula (IV):

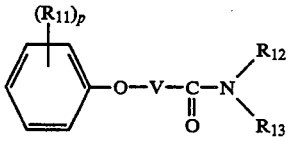

formula (IV)

wherein $R_{11}$ represents a halogen atom, an alkyl group, or an alkoxy group, $R_{12}$ and R13 each independently represent a hydrogen atom or an alkyl group, V represents an alkylene group, p is an integer of 1 to 3, when p is an integer of 2 or 3, the $R_{11}$ groups may be same or different, and $R_{12}$ and $R_{13}$ may bond together to form a 5- to 7-membered ring.

9. The silver halide color photographic material as claimed in claim 1, wherein the coupler represented by formula (I-1) or (I-2) is contained in the range of 0.1 to 2 mmol per $m^2$ of the silver halide color photographic material.

10. The silver halide color photographic material as claimed in claim 1, wherein the compound represented by formula (II) is used in the range of 0.01 to 2.0% in weight ratio to the yellow coupler represented by formula (I-1) or (I-2).

11. The silver halide color photographic material as claimed in claim 2, wherein the compound represented by formula (III ) is used in the range of 0.01 to 2.0% in weight ratio to the yellow coupler represented by formula (I-1) or (I-2).

12. The silver halide color photographic material as claimed in claim 1, wherein the compound represented by formula (II) is used as a solvent for the yellow coupler.

13. The silver halide color photographic material as claimed in claim 2, wherein the compound represented by formula (III) is used as a solvent for the yellow coupler.

14. The silver halide color photographic material as claimed in claim 1, wherein the silver halide emulsion in the yellow color-forming silver halide emulsion layer is a silver chloride emulsion or a silver bromochloride emulsion substantially free from silver iodide and having a silver chloride content of 90 mol % or more.

15. The silver halide color photographic material as claimed in claim 1, wherein all of silver halide emulsions in the silver halide color photographic material are silver chloride emulsion or silver bromochloride emulsions substantially free from silver iodide and having a silver chloride content of 90 mol % or more.

16. The silver halide color photographic material as claimed in claim 1, wherein $X^1$ and $X^2$ each represent an alkyl group or an aryl group.

17. The silver halide color photographic material as claimed in claim 1, wherein the heterocyclic group formed by $X^3$ together with the >N— is 1-indolinyl.

18. The silver halide color photographic material as claimed fin claim 1, wherein $X^1$ and $X^2$ in formula (I-1) or (I-2) represent an alkyl group having 1 to 30 carbon atoms.

19. The silver halide color photographic material as claimed in claim 1, wherein $X^1$ and $X^2$ represent a heterocyclic group having 3 to 12 members in the ring, a carbon number of 1 to 20, and at least one hetero atom selected from the group consisting of nitrogen, oxygen and sulfur.

20. The silver halide color photographic material as claimed in claim 1, wherein said yellow coupler is present in an emulsified dispersion.

* * * * *